US011685072B2

(12) United States Patent
Biros et al.

(10) Patent No.: US 11,685,072 B2
(45) Date of Patent: Jun. 27, 2023

(54) CARTRIDGE ADAPTED TO SECURE RECIPROCATING BREAD SLICER BLADES

(71) Applicant: OLIVER PACKAGING AND EQUIPMENT COMPANY, Grand Rapids, MI (US)

(72) Inventors: James A. Biros, Nunica, MI (US); Conor Alan Fredricks, Spring Lake, MI (US); Vance John Matz, Cedar Springs, MI (US); Bruce Alan Fredricks, Grand Haven, MI (US); Yvonne M. Johnson, Rockford, MI (US); David Blugerman Miller, Whitehall, MI (US); John Curtis Kortman, Muskegon, MI (US)

(73) Assignee: OLIVER PACKAGING AND EQUIPMENT COMPANY, Grand Rapids, MI (US)

( * ) Notice: Subject to any disclaimer, the term of this patent is extended or adjusted under 35 U.S.C. 154(b) by 0 days.

(21) Appl. No.: 17/339,564

(22) Filed: Jun. 4, 2021

(65) Prior Publication Data

US 2022/0388192 A1 Dec. 8, 2022

(51) Int. Cl.
*B26D 7/26* (2006.01)
*B26D 1/00* (2006.01)
(Continued)

(52) U.S. Cl.
CPC ..... *B26D 7/2614* (2013.01); *B26D 1/0006* (2013.01); *B26D 1/06* (2013.01);
(Continued)

(58) Field of Classification Search
CPC ..... B26D 7/2614; B26D 1/0006; B26D 1/06; B26D 2001/0013; B26D 2001/0033; B26D 2210/06; B26D 1/48
See application file for complete search history.

(56) References Cited

U.S. PATENT DOCUMENTS 1,841,144 A * 1/1932 Nelson ..... B26D 7/2614 83/751
1,968,020 A 7/1934 Bettendorf
(Continued)

FOREIGN PATENT DOCUMENTS

FR 3052995 A1 12/2017
WO 2011095185 A1 8/2011
(Continued)

OTHER PUBLICATIONS

European Search Report for EP22176454.1 dated Nov. 3, 2022.

*Primary Examiner* — Jonathan G Riley
(74) *Attorney, Agent, or Firm* — McNees Wallace & Nurick LLC

(57) ABSTRACT

A cartridge adapted to secure reciprocating bread slicer blades including a rectangular frame having a planar surface, the frame having a plurality of pairs of opposed holders, each pair of the opposed holders adapted to releasably secure opposed ends of a corresponding bread slicer blade. The frame is adapted to secure a plurality of aligned bread slicer blades defining a plane offset from the frame planar surface. The frame is adapted to selectively maintain each of the plurality of aligned bread slicer blades in tension.

19 Claims, 20 Drawing Sheets

(51) Int. Cl.
*B26D 1/06* (2006.01)
*B26D 7/28* (2006.01)

(52) U.S. Cl.
CPC ..... *B26D 7/28* (2013.01); *B26D 2001/0013* (2013.01); *B26D 2001/0033* (2013.01); *B26D 2210/06* (2013.01)

(56) References Cited

U.S. PATENT DOCUMENTS 3,889,699 A * 6/1975 Ranieri ..... B26D 1/553 125/17
5,327,807 A * 7/1994 Chang ..... B23D 51/125 83/581.1
5,904,083 A * 5/1999 Jensen ..... B26D 7/22 83/62.1
5,979,281 A 11/1999 Ceasar
6,123,004 A 9/2000 Matz
6,622,602 B2 9/2003 Rompa
9,511,504 B2 12/2016 Whitney
2004/0023774 A1 12/2004 Stinnett
2012/0085216 A1* 4/2012 Lobbia ..... B26D 1/06 83/821
2012/0297947 A1* 11/2012 Van Cauwenberghe ..... B26D 1/0006 83/167
2016/0052156 A1 2/2016 Wright
2018/0085966 A1* 3/2018 Schmidt ..... B26D 1/143

FOREIGN PATENT DOCUMENTS

WO 2013046890 A1 4/2013
WO WO-2013046890 A1 * 4/2013 ..... B26D 1/48

* cited by examiner

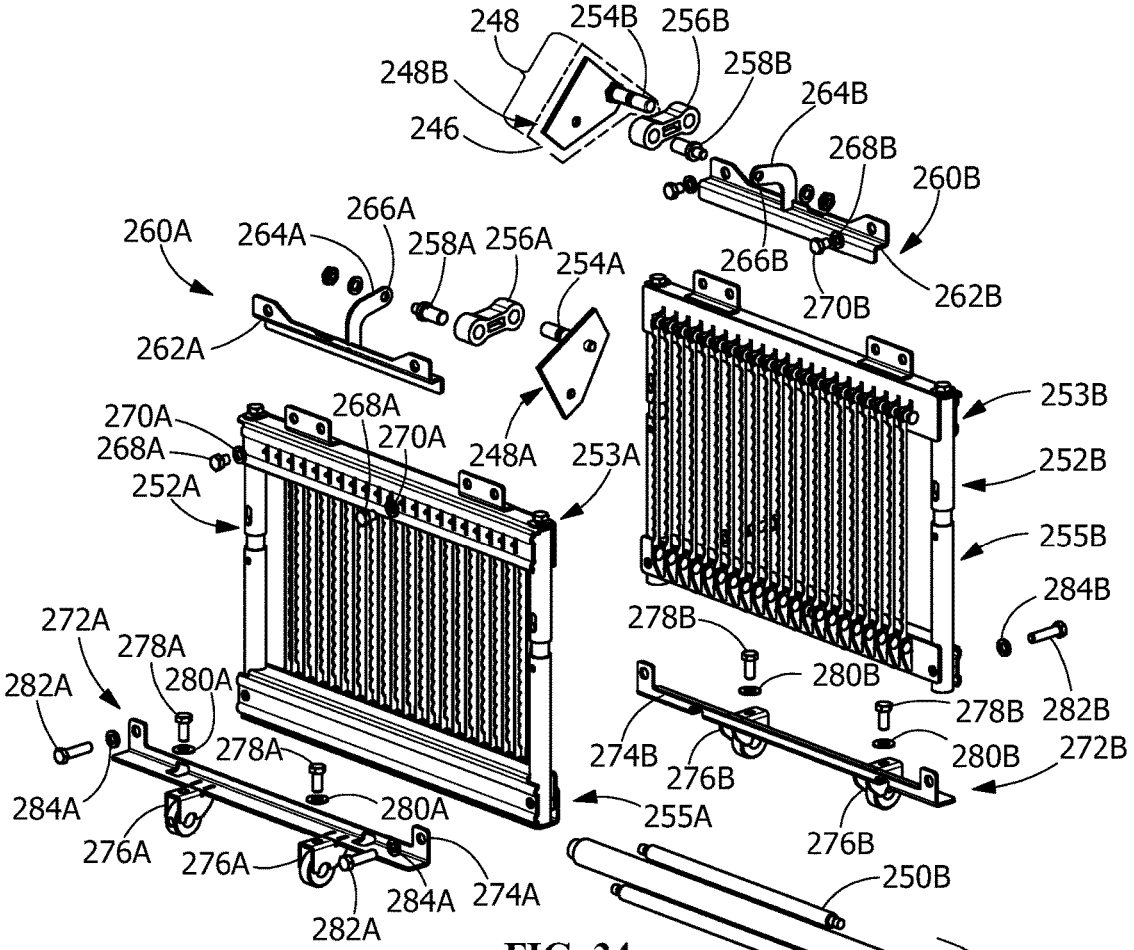
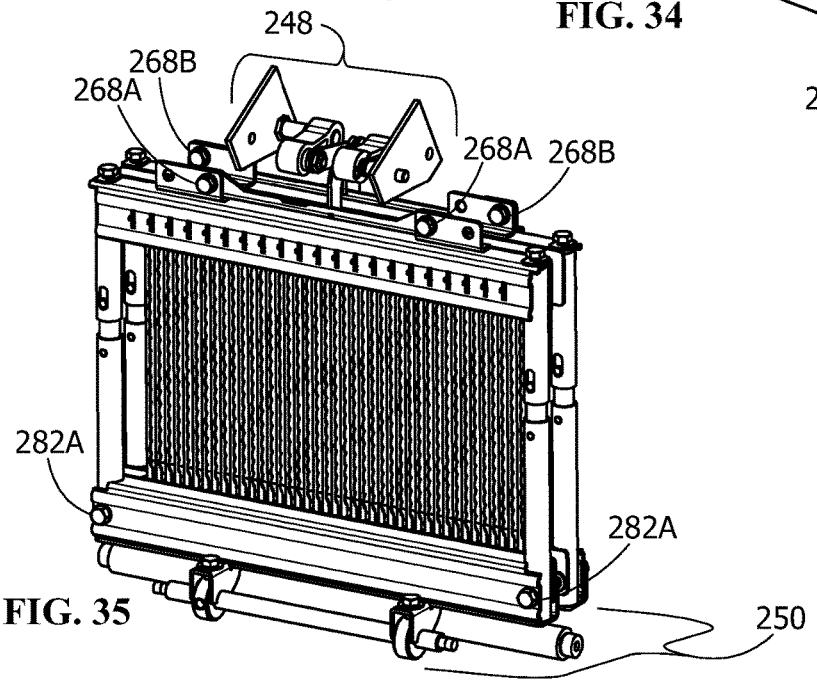
FIG. 35

CARTRIDGE ADAPTED TO SECURE RECIPROCATING BREAD SLICER BLADES

FIELD OF THE INVENTION

The present invention is directed to apparatus for use with a bread slicer, and specifically to apparatus for securing reciprocating bread slicer blades for a bread slicer.

BACKGROUND OF THE INVENTION

Bread slicer machines, such as are widely used in eating establishments that serve sliced bread, utilize a plurality of closely spaced slicer blades for slicing the bread loaves into individual slices. Not surprisingly, some bread slicer blades are configured to operate more effectively with lower density breads, while other bread slicer blades are configured to operate more effectively with higher density breads. Unfortunately, conventional slicer blades are difficult to change out (i.e., the slicer blades are required to be changed out one blade at a time), and, as a result, the installed bread slicer blades are often used for extended periods of time, even after dulling has occurred, resulting in reduced bread slicer performance. Furthermore, since devices for securing bread slicer blades have a fixed spacing, all breads sliced using the same device similarly will produce slices of the same width, preventing enhanced enjoyment of breads that may be more favorably served having different widths.

What is needed is a device for securing bread slicer blades that does not suffer from these drawbacks.

SUMMARY OF THE INVENTION

In one embodiment, a cartridge adapted to secure reciprocating bread slicer blades includes a rectangular frame having a planar surface, the frame having a plurality of pairs of opposed holders, each pair of the opposed holders adapted to releasably secure opposed ends of a corresponding bread slicer blade. The frame is adapted to secure a plurality of aligned bread slicer blades defining a plane offset from the frame planar surface. The frame is adapted to selectively maintain each of the plurality of aligned bread slicer blades in tension.

In another embodiment, a system adapted to secure reciprocating bread slicer blades includes a rectangular frame having a planar surface, the frame having a plurality of pairs of opposed holders, each pair of the opposed holders adapted to releasably secure opposed ends of a corresponding bread slicer blade. The frame is adapted to secure a plurality of aligned bread slicer blades defining a plane offset from the frame planar surface. The frame is adapted to selectively maintain each of the plurality of aligned bread slicer blades in tension during use. The frame is adapted to selectively remove tension from each of the plurality of aligned bread slicer blades during non-use. The system further includes a blade carrier capable of carrying the plurality of bread slicer blades, the blade carrier permitting installation or removal of the plurality of bread slider blades from/into the frame.

In a further embodiment, a bread slicer includes a rectangular frame having a planar surface, the frame having a plurality of pairs of opposed holders, each pair of the opposed holders adapted to releasably secure opposed ends of a corresponding bread slicer blade. The frame is adapted to secure a plurality of aligned bread slicer blades defining a plane offset from the frame planar surface. The frame is adapted to selectively maintain each of the plurality of aligned bread slicer blades in tension. The frame includes a first frame portion and a second frame portion for each engaging a corresponding mounting feature of the bread slicer. The first frame portion includes a first frame subportion selectively secured by at least one fastener thereto, and the second frame portion includes a second frame subportion selectively secured by at least one fastener thereto. Upon removal of the at least one fastener securing the first frame portion and the first frame subportion and the at least one fastener securing the second frame portion and the second frame subportion, the frame is disconnected from the bread slicer.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

FIG. 34 is an exploded view of exemplary frame cartridges adapted to secure a plurality of bread slicer blades, which frame cartridges also selectively removable from a bread slicer.

FIG. 35 is an upper perspective view of the assembled frame cartridges of FIG. 34.

Wherever possible, the same reference numbers will be used throughout the drawings to refer to the same or like parts.

DETAILED DESCRIPTION OF THE INVENTION

Figure 1:
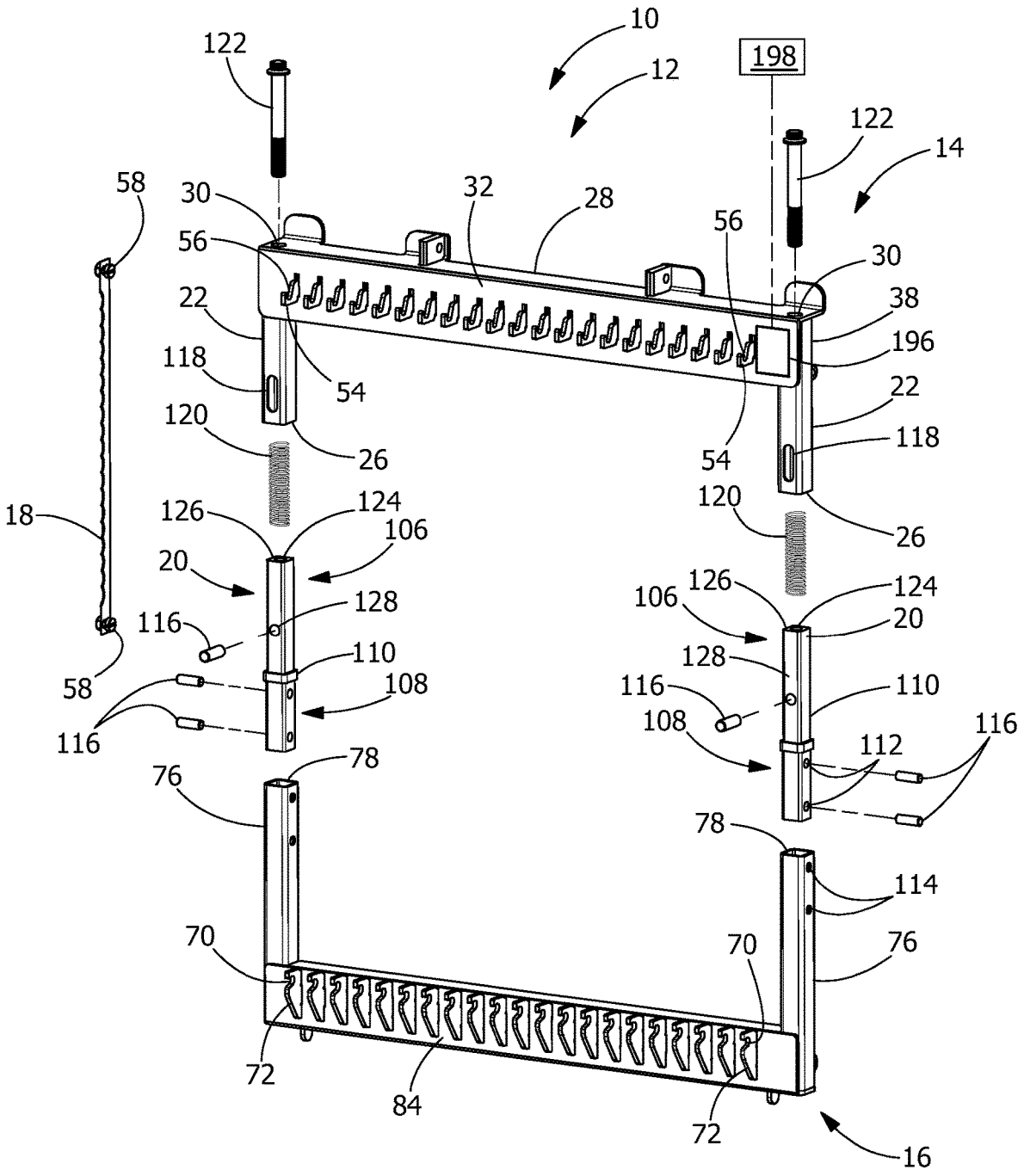
FIG. 1 is an exploded view of an exemplary cartridge frame adapted to secure a plurality of bread slicer blades.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

The present invention includes a cartridge 10 that is adapted to secure reciprocating bread slicer blades, which cartridge being insertable in a bread slicing machine (not shown) that is well known and not further discussed herein. Cartridge 10 is easily inserted or removed from the bread slicing machine, permitting different cartridges using different types of bread slicer blades and/or different spacings between corresponding bread slicer blades, permitting optimum operation of the bread slicing machine, and enhanced enjoyment of the sliced bread. Moreover, the present invention includes a blade carrier capable of carrying the plurality of bread slicer blades, the blade carrier permitting installation or removal of the plurality of bread slider blades from/into the frame, providing a significant improvement over systems requiring the slicer blades to be changed out one blade at a time.

Figure 2:
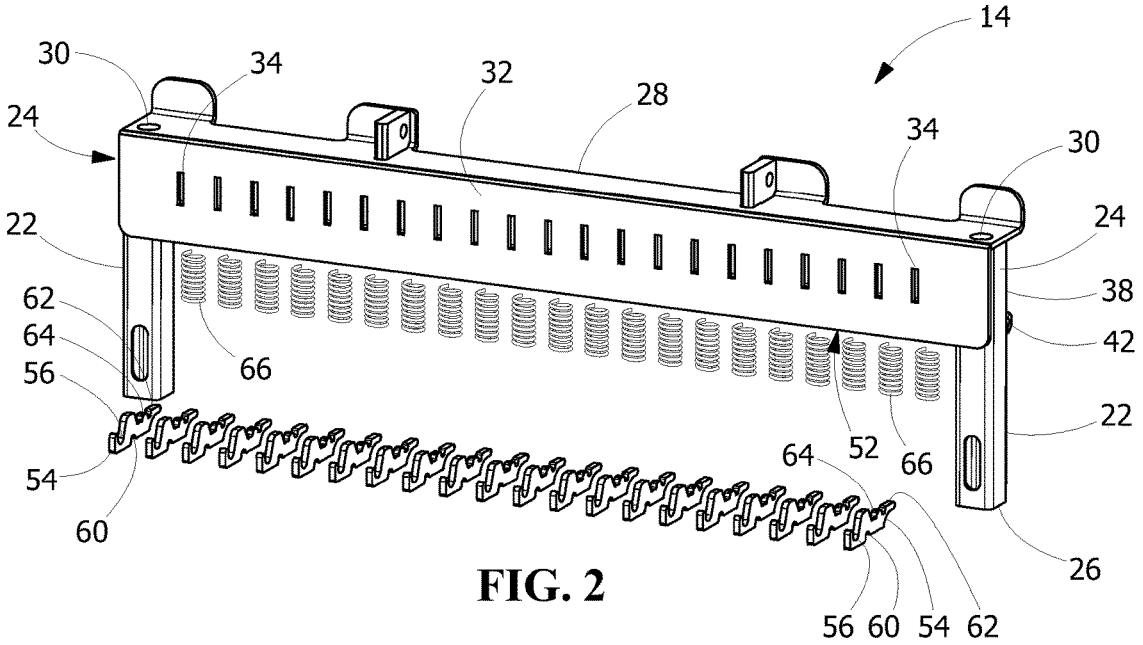
FIG. 2 is a partially exploded view of an upper portion of the cartridge frame of FIG. 1.
Figure 3:
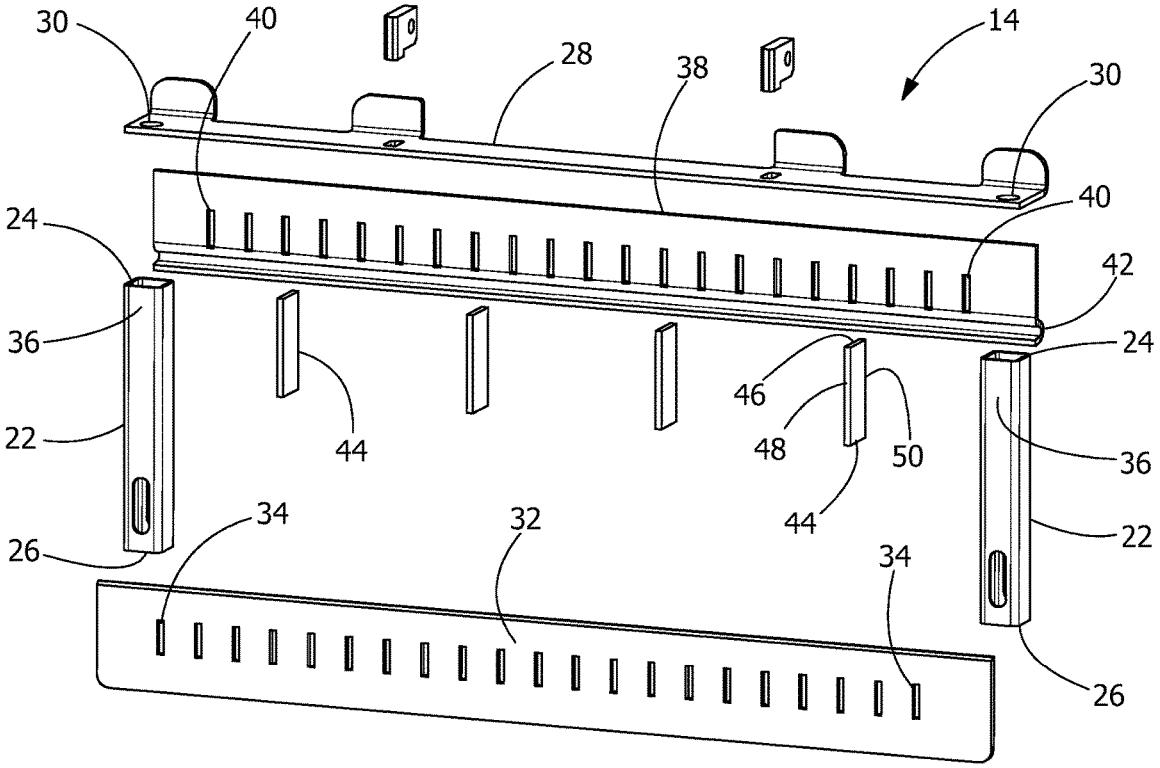
FIG. 3 is an exploded view of the upper portion of the cartridge frame of FIG. 2.

As shown in FIGS. 1-13, and more specifically in FIG. 1 in an exploded view, an exemplary cartridge 10 includes an open rectangular frame 12 having an upper frame portion 14 such as a weldment defining a C shape, a lower frame portion 16 such as a weldment defining a C shape, and a pair of inserts 20 received by each of the frame portions 14, 16. As shown in FIGS. 2-3, upper frame portion 14 includes a pair of opposed tubes 22 such as rectangular tubes each having opposed ends 24, 26. A cap 28 extends over each end 24 of the pair of tubes 22, with apertures 30 at opposite ends of cap 28 corresponding to or in alignment with the open ends 24 of parallel tubes 22, cap 28 being mutually perpendicular to tubes 22. A plate 32 having a plurality of slits 34 is affixed to corresponding planar surfaces 36 (FIG. 3) near end 24 of tubes 22, and a plate 38 having a plurality of slits 40 (FIG. 3) is affixed to planar surfaces opposite surfaces 36 (FIG. 3) near end 24 of tubes 22. Collectively, as shown in FIG. 2, plate 32, cap 28, and plate 38 form a continuous C-shaped structure 52 extending between tubes 22 and over ends 24 of tubes 22. Plate 38 includes a stiffening ridge 42 that extends along an edge opposite cap 28. A plurality of gussets 44 (FIG. 3) are inserted inside of C-shaped structure 52 with edges 46, 48, 50 (FIG. 3) of gussets 44 (FIG. 3) being affixed to inner corresponding surfaces of respective cap 28, plate 32, plate 38 to provide further structural stiffness and strength to upper frame portion 14. Each of aligned slits 34, 40 of plates 32, 38 receive a blade fitting holder or holder 54. Upper frame portion 14 includes holder 54.

It is appreciated by those having ordinary skill in the art that one or more of the tubes of upper frame portion 14 (i.e., tubes 22), lower frame portion 16 (i.e., tubes 76) and inserts 20 may be circular tubes or define any other shape so long as the tubes fit together and function as disclosed herein.

Returning to FIG. 2, and as shown installed (FIG. 1), one end of holder 54 extends outwardly from the outer surface of plate 32 (FIG. 1) and has a feature 56 for pivotably engaging and securing to a corresponding feature 58 (FIG. 1) of a bread slicer blade or blade 18 (FIG. 1). Holder 54 includes a notch 60 for engaging an end of the corresponding slit 34 of plate 32 opposite cap 28, with the remaining portion of holder 54 extending inside of C-shaped structure 52 and terminating at a tip 62 that extends through the opposite side of C-shaped structure 52, i.e., through slit 40 (FIG. 3) of plate 38. Holder 54 further includes a protrusion 64 near tip 62 for receiving one end of a spring 66 captured in C-shaped structure 52, the opposite end of spring abutting or contacting the inner or inside surface of cap 28 of C-shaped structure 52.

Figure 12:
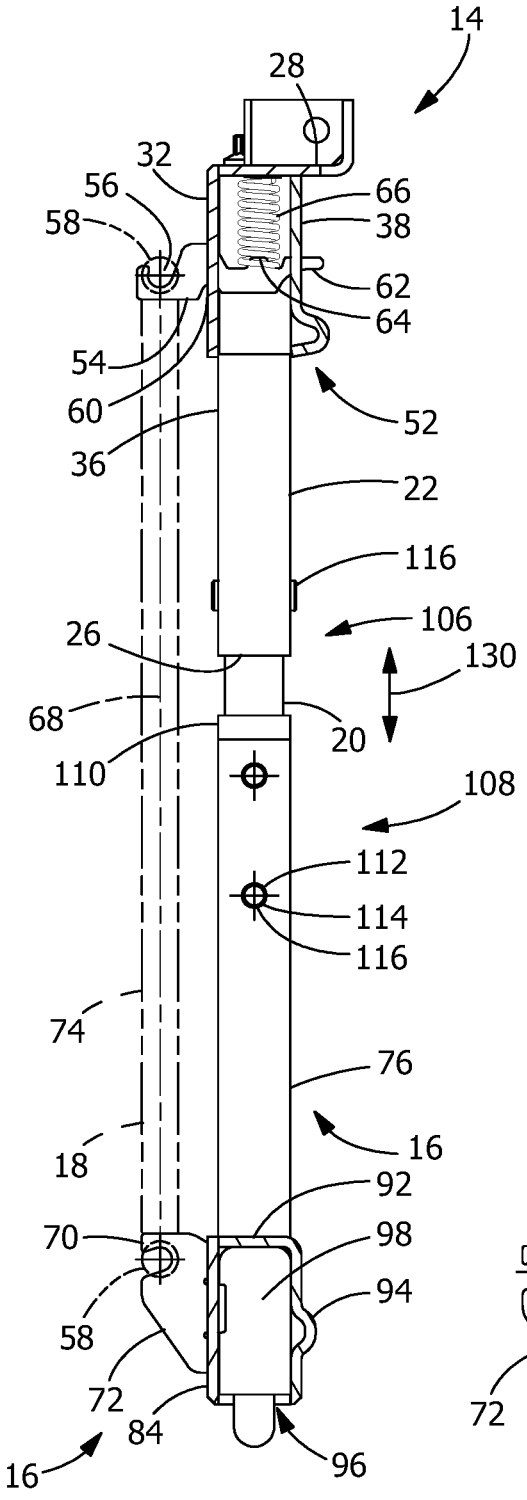
FIG. 12 is a view taken along line 12-12 of the assembled cartridge frame of FIG. 7.
Figure 13:
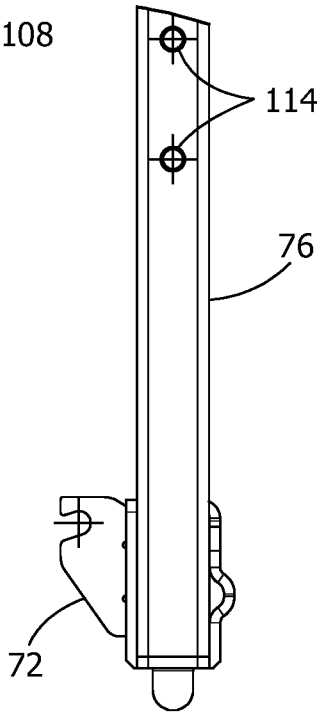
FIG. 13 is a side elevation view taken along line 13-13 of the lower portion of the cartridge frame of FIG. 5.

In other words, as shown in FIG. 12, notch 60 acts as a fulcrum of a class 1 lever of holder 54, the load being associated with the force placing the bread slicer blade 18 in tension along line of force 68 extending through opposed features 68 of blade 18, one feature 68 of blade 18 engaging with corresponding feature 56 of holder 54 of upper frame portion 14 and the other feature 68 of blade 18 engaging with a feature 70 of a holder 72 of lower frame portion 16, generally about 50-200 pounds of tensile force per blade, and the retention force applied by compressed spring 66 results in the tension force applied to bread slicer blade 18 (FIG. 1). In one embodiment, the blade tensile force is less than 50 pounds per blade. In one embodiment, the blade tensile force is greater than 200 pounds per blade. As a result of this arrangement, a plane 74 defined by a plurality of aligned blades 18 such as corresponding to the ends of the serrated slicer edges is offset from planar surfaces 36 (two planar surfaces 36 shown in FIG. 3; in one embodiment in which one or both of tubes 22 are circular, the pair of surfaces 36 (in the instance that both of tubes 22 are circular, each of surfaces 36 are parallel lines) collectively define a planar surface of tubes 22 of upper frame portion 14. As is appreciated by one having ordinary skill in the art, each holder 54 is constrained to rotate about its respective notch 60, i.e., about the lower edge of slit 34 of plate 32 as guided by the confines of the corresponding aligned vertically extending slits 34, 40 of respective plates 32, 38, the angular travel of tip 62 being limited by the upper and lower ends of slit 40 of plate 38. This is important, as the distance between features 56, 70 of respective holders 54, 72 is selectively variable, as will be discussed in additional detail below.

Figure 4:
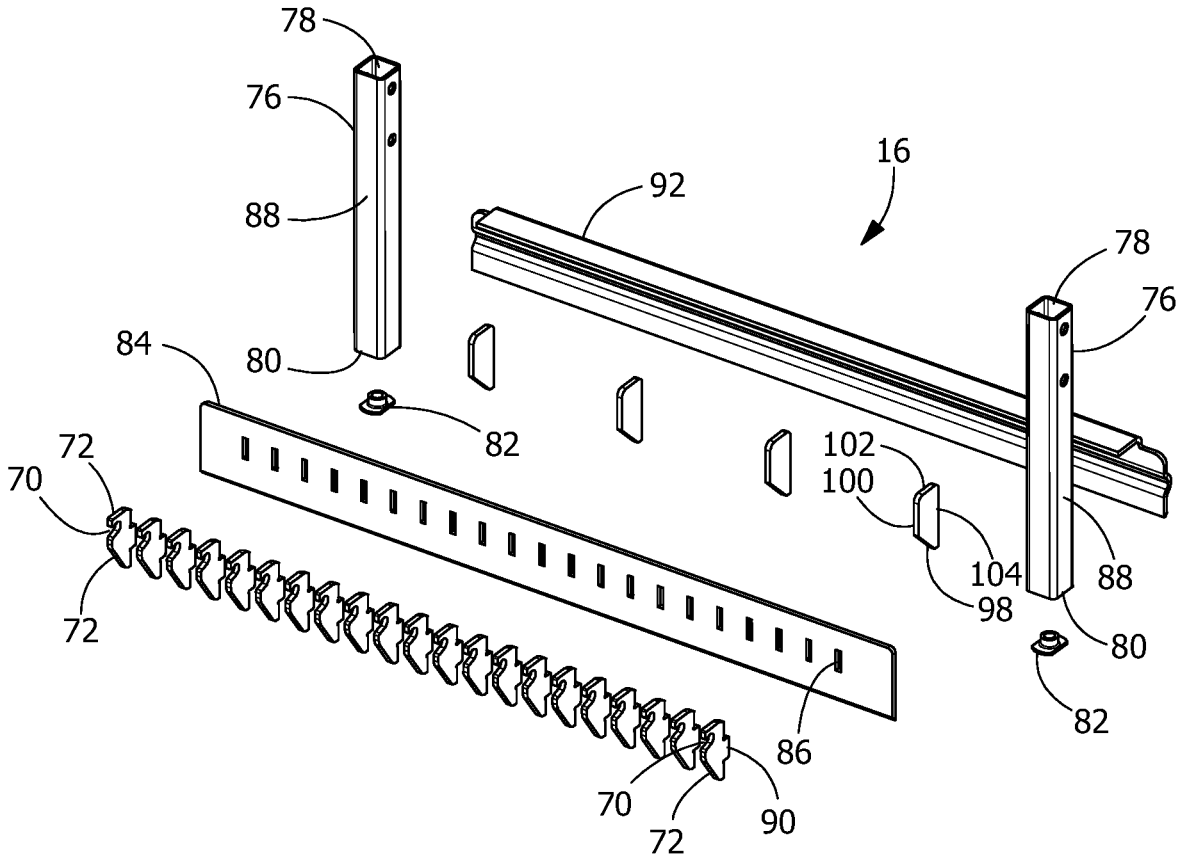
FIG. 4 is an exploded view of a lower portion of the cartridge frame of FIG. 1.
Figure 5:
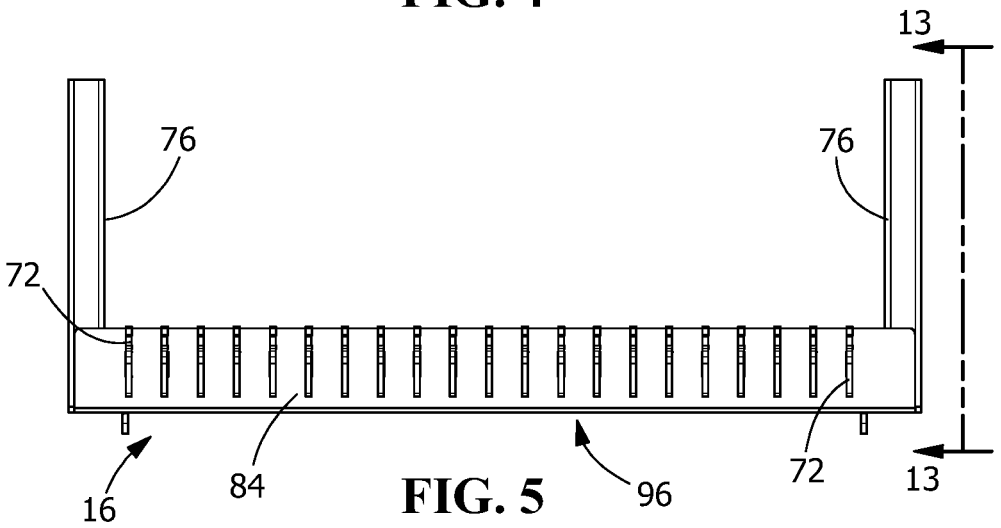
FIG. 5 is a front elevation view of a lower portion of the cartridge frame of FIG. 1.

FIG. 4 shows an exploded view of lower frame portion 16, which is similar to previously discussed upper frame portion 14 (FIG. 1) is now discussed (FIG. 5 shows the assembled lower frame portion 14). Lower frame portion 16 includes a pair of opposed tubes 76 such as rectangular tubes each having opposed ends 78, 80. As shown, a cap 82 extends over each end 80 of the pair of tubes 76. A plate 84 having a plurality of slits 86 is affixed to corresponding planar surfaces 88 (FIG. 3) near end 80 of tubes 76, plate 84 being mutually perpendicular to parallel tubes 76. Slits 86 are adapted to each receive a protrusion 90 of a corresponding holder 72 that are then welded together or otherwise appropriately secured to one another. Lower frame portion 16 includes holder 72.

Figure 6:
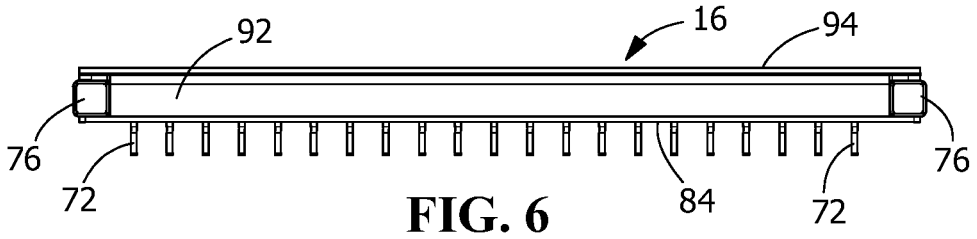
FIG. 6 is a plan view of the lower portion of the cartridge frame of FIG. 1.
Figure 7:
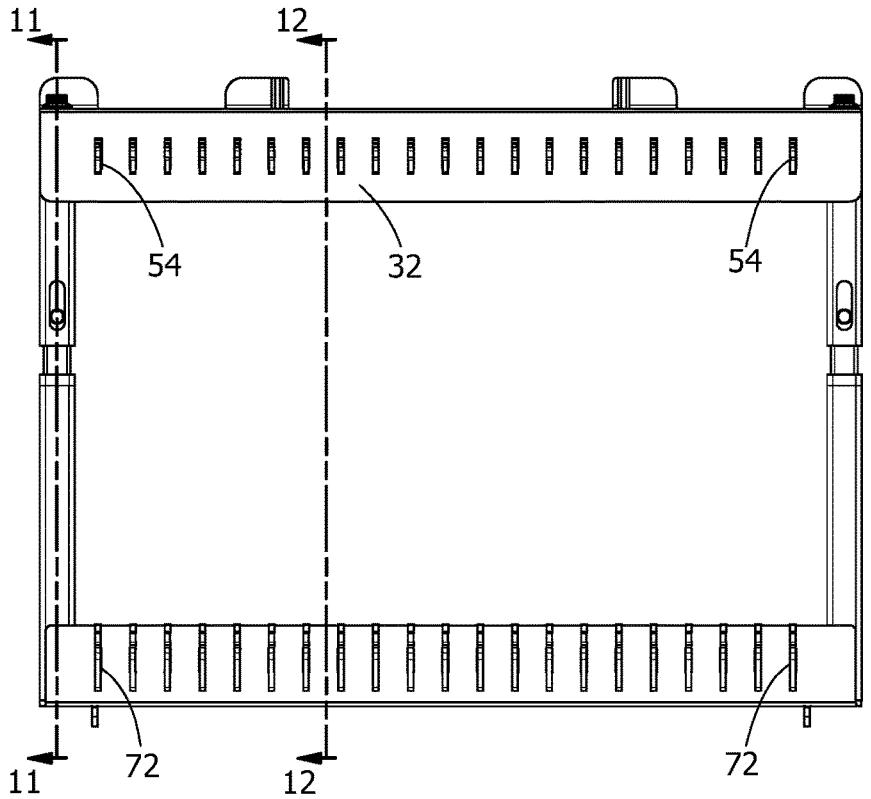
FIG. 7 is a front elevation view of the assembled cartridge frame of FIG. 1.
Figure 8:
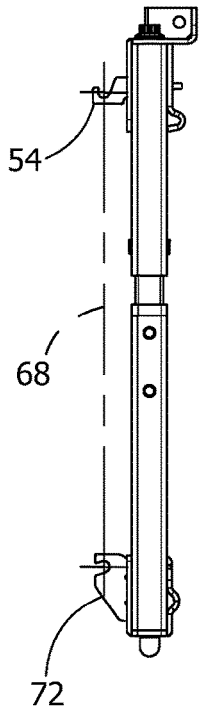
FIG. 8 is a side elevation view of the assembled cartridge frame of FIG. 7.
Figure 9:
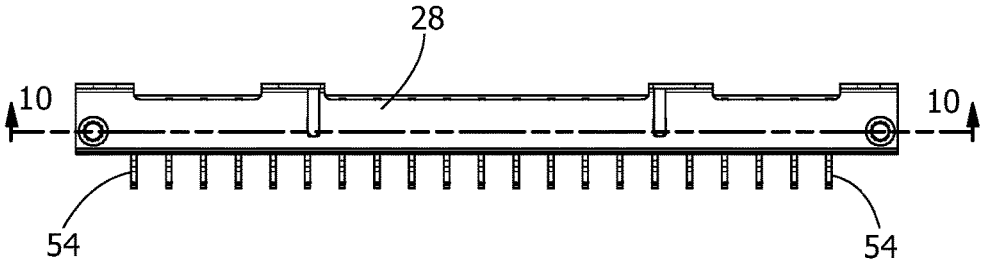
FIG. 9 is a plan view of the assembled cartridge frame of FIG. 7.
Figure 10:
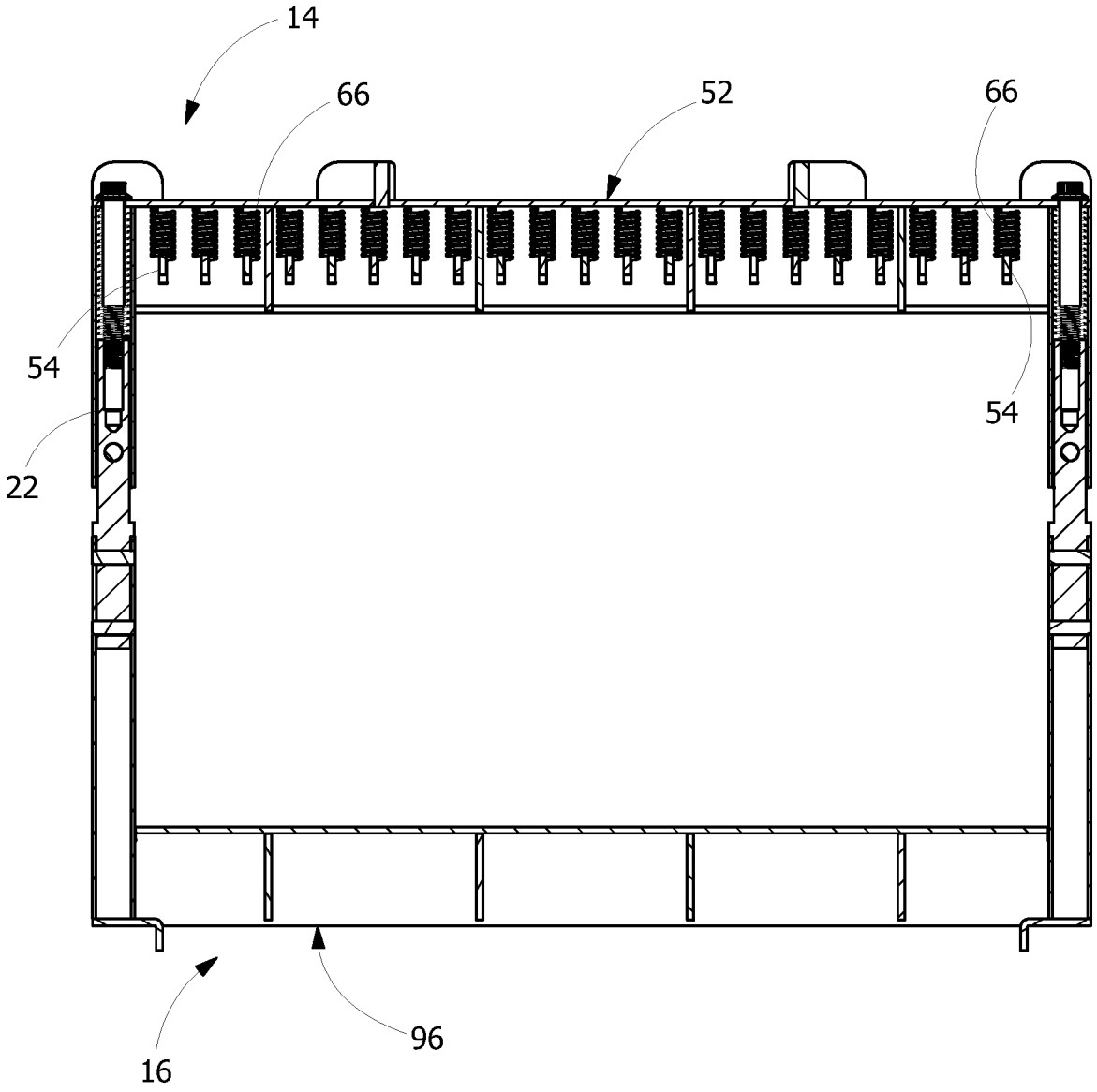
FIG. 10 is a view taken along line 10-10 of the assembled cartridge frame of FIG. 9.

As further shown in FIG. 4, an L-shaped member 92 having a stiffening ridge 94 formed along its length extends between tubes 76 near ends 80. Collectively, as shown in FIGS. 5-6 and 12, plate 84 and L-shaped member 92 form a continuous C-shaped structure 96 extending between tubes 76 near ends 80 (FIG. 4) of tubes 76. A plurality of gussets 98 (FIG. 4) are inserted inside of C-shaped structure 96 with edges 100, 102, 104 (FIG. 4) of gussets 98 (FIG. 4) being affixed to inner corresponding surfaces of respective plate 84 and L-shaped member 92 to provide further structural stiffness and strength to C-shaped structure 96 of lower frame portion 16.

Figure 11:
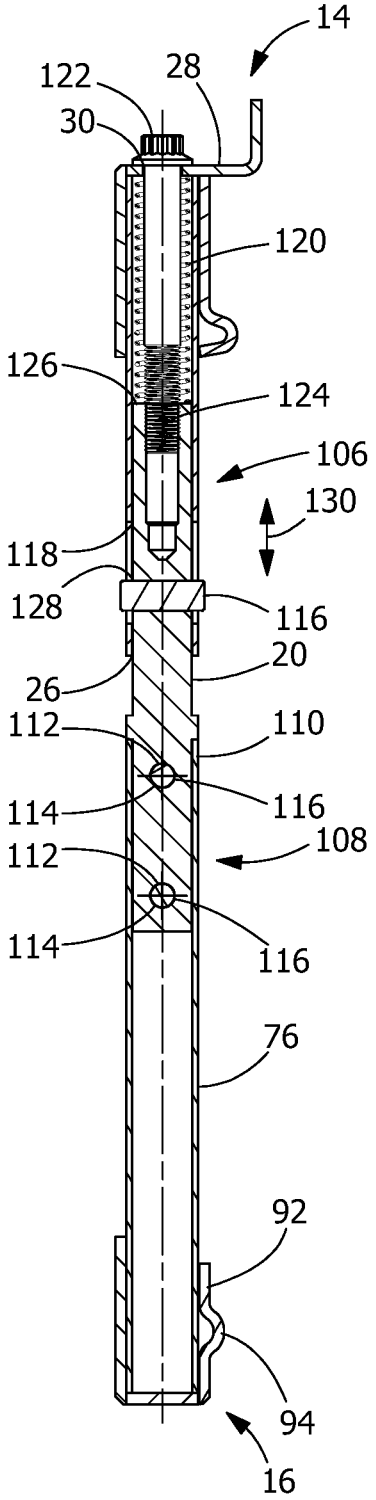
FIG. 11 is a view taken along line 11-11 of the assembled cartridge frame of FIG. 7.

As shown in FIG. 1 (in an exploded view) and in FIGS. 11 and 12 (as assembled together), the structure joining upper frame portion 14 and lower frame portion 16 is now further discussed. Insert 20 includes an upper portion 106 and a lower portion 108 separated from one another by a peripheral ridge or protrusion 110. Lower portion 108 of a corresponding insert 20 is directed through each end 78 of tube 76 of lower portion 16 until the peripheral protrusion 110 abuts end 78, and corresponding apertures 112 formed in lower portion 106 are aligned with apertures 114 formed in tubes 76 and secured together with fasteners such as spring pins 116. As a result, after assembly, there is no relative movement between insert 20 and lower frame portion 16.

Figure 24:
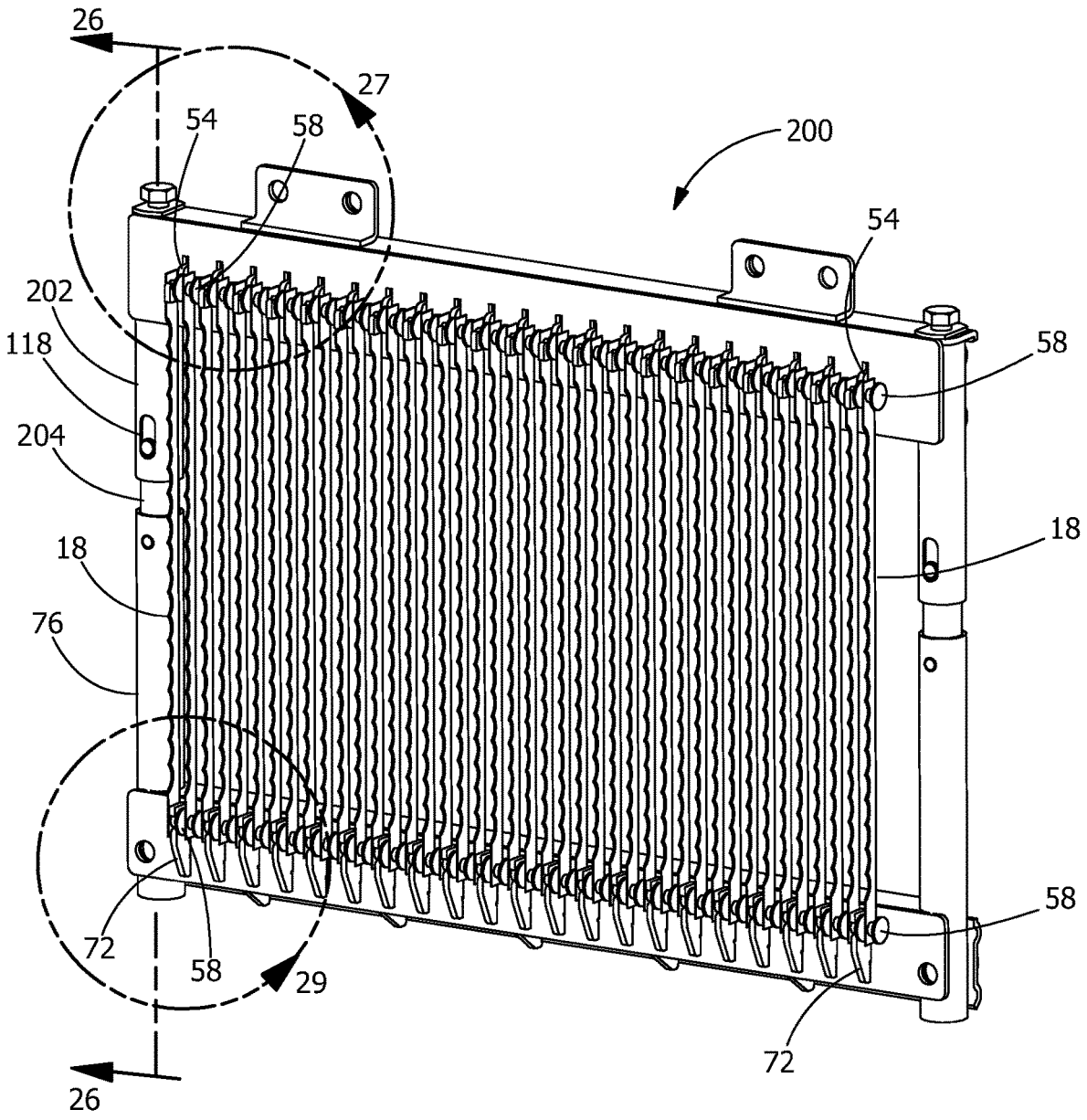
FIG. 24 is an upper perspective view of an exemplary cartridge frame securing a plurality of bread slicer blades.
Figure 26:
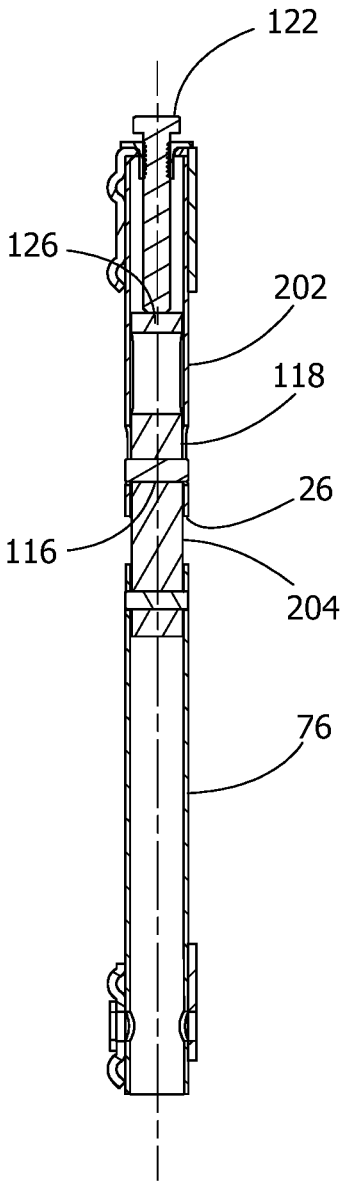
FIG. 26 is a cross section taken along line 26-26 of the cartridge frame of FIG. 24.
Figure 25:
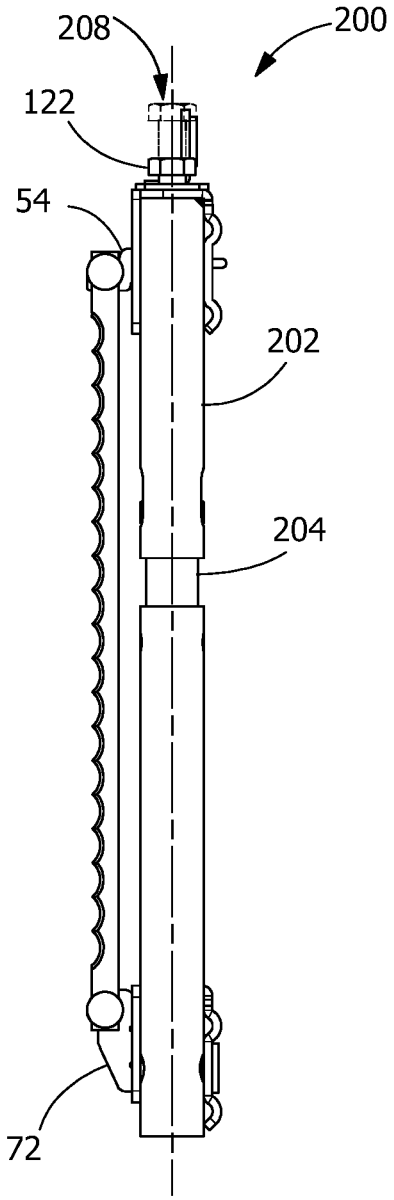
FIG. 25 is a side elevation view of the cartridge frame of FIG. 24.

As further shown collectively in FIGS. 1, 11, and 12, a slot 118 is formed near end 26 of each tube 22 of upper frame portion 22. Optionally, a spring 120 (shown in FIGS. 1, 11) is inserted inside of end 26 of each tube 22 and then end 26 of each tube 22 is directed to slide over upper portion 106 of a corresponding insert 20. (For example, FIGS. 24-26 are directed to an exemplary cartridge that does not utilize spring 120, as will be discussed in additional below.) A fastener 122 (shown in FIGS. 1, 11) such as a bolt such as a shoulder bolt is directed through a corresponding aperture 30 (shown in FIGS. 1, 11) of cap 28 (shown in FIGS. 1, 11), then through tube 22, then through spring 120 (shown in FIGS. 1, 11) and then threadedly engaging a threaded aperture 124 (shown in FIGS. 1, 11) formed in an end 126 (shown in FIGS. 1, 11) of upper portion 106 of insert 20 until a predetermined preload is achieved as a result of compressing spring 120 between the head of fastener 122 (shown in FIGS. 1, 11) and end 126 (shown in FIGS. 1, 11) of upper portion 106 of insert 20. Once the predetermined preload is achieved, slot 118 (shown in FIGS. 1, 11) is positioned over an aperture 128 (shown in FIGS. 1, 11) formed in upper portion 106 of insert 20, and a spring pin 116 is directed into aperture 128, thereby securing upper frame portion 14 and insert 20 together. However, one having ordinary skill in the art appreciates that upper frame portion 14 and insert 20 are not nonmovingly affixed to one another, as spring pin 116 is movable within the extent of slot 118 (shown in FIGS. 1, 11) resulting in movement of upper frame portion 14 relative to insert 20 in movement directions 130 (FIGS. 11, 12).

Figure 22:
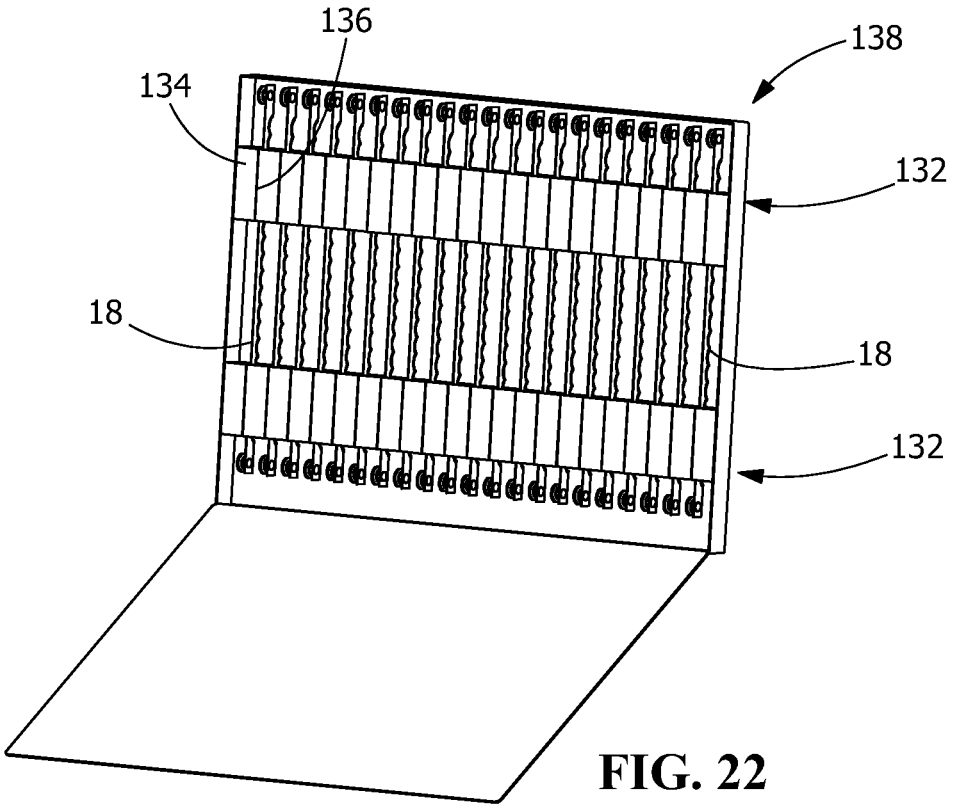
FIG. 22 is an exemplary blade carrier for carrying a plurality of bread slicer blades.

A benefit of the relative movement of upper frame portion 14 relative to insert 20 in movement directions 130 (FIGS. 11, 12) is that a length of frame 12 (FIG. 1) in a direction parallel to blades 18 (FIG. 1) is selectively variable, permitting frame 12 to selectively adjust and maintain the tension of blades 18. That is, as shown in FIG. 11, as a result of selectively adjusting the amount of engagement of fastener 122 in threaded aperture 124 of insert 20, upper frame portion 14 is movable in movement direction 130 within the confines of slot 118, and the distance between opposed holders 54, 72 (FIG. 12) is similarly varied by the amount of such relative movement, permitting selective adjustment of the tension of all of blades 18 between a maximum amount of tension when the distance between holders 54, 72 is at a maximum distance (pin 116 abutting one extent of slot 118) and total removal of tension from all of the blades 18 as the distance between holders 54, 72 approaches a minimum distance (pin 116 approaching abutment of the opposite extent of slot 118), permitting all of blades 18 to be removed, such as with a blade carrier 132 (FIG. 132). Stated another way, in response to the frame length in a direction parallel to the blades 18 being a predetermined length, tension is removed from the blades 18, permitting removal of the blades from the cartridge. Blade carrier 132 (FIG. 132) comprises a material mass 134 such as a block of resilient material into which are formed a plurality of slits 136 sized to each receive a blade 18, which slits are spaced apart at a spacing corresponding to the spacing between holders 54, 72. If less than all of the blades 18 are contained in the frame 12, or if less than all the blades 18 are contained in blade carrier 132, that number of blades can be installed/removed as desired. As further shown in FIG. 22, a single carrier block 132 or a plurality (two carrier blocks shown in FIG. 22) or a number more than two may be used as desired/appropriate. As further shown in FIG. 22, the blades 18 positioned in blade carrier 132 may be kept in a container 138 for protection of the blades 18 and persons handling the blades prior to installation.

Figure 14:
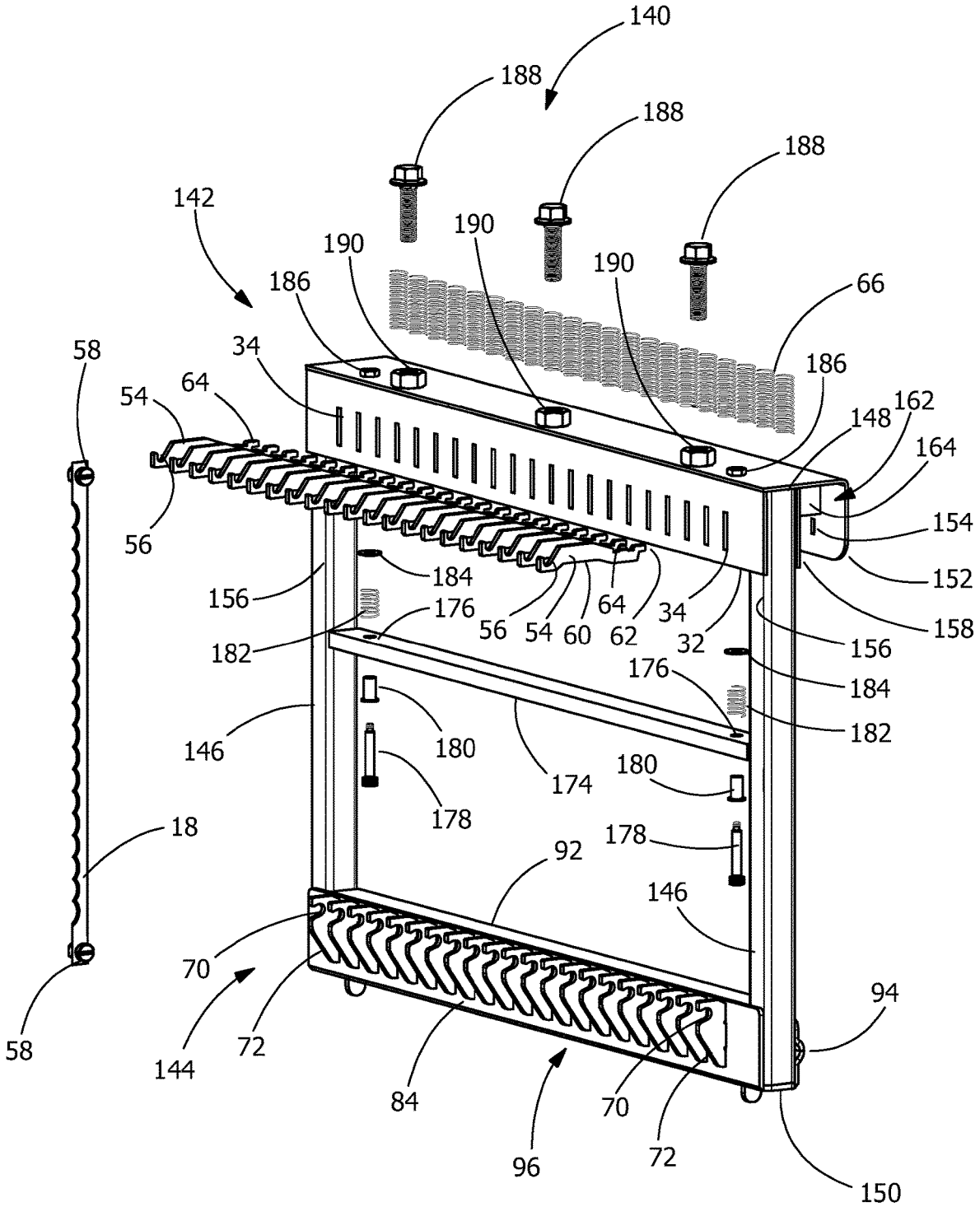
FIG. 14 is a partially exploded view of an exemplary cartridge frame adapted to secure a plurality of bread slicer blades.
Figure 16:
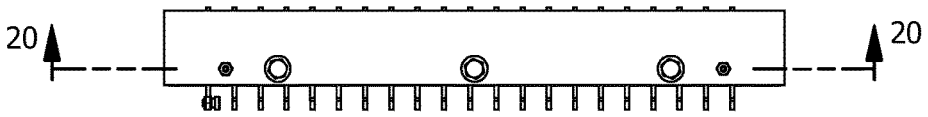
FIG. 16 is a plan view of the assembled cartridge frame of FIG. 15.
Figure 15:
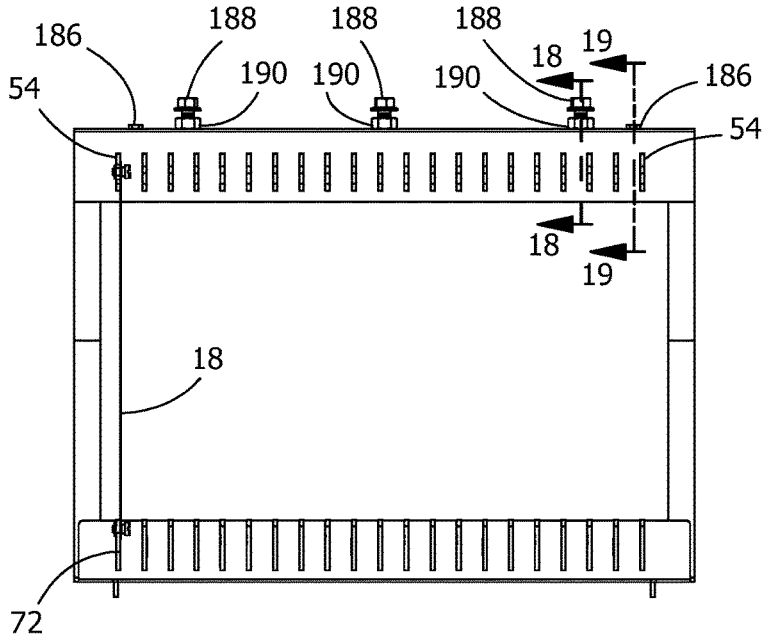
FIG. 15 is a front elevation view of an assembled cartridge frame of FIG. 14.
Figure 17:
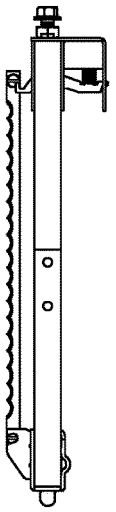
FIG. 17 is a side elevation view of the assembled cartridge frame of FIG. 15.
Figure 21:
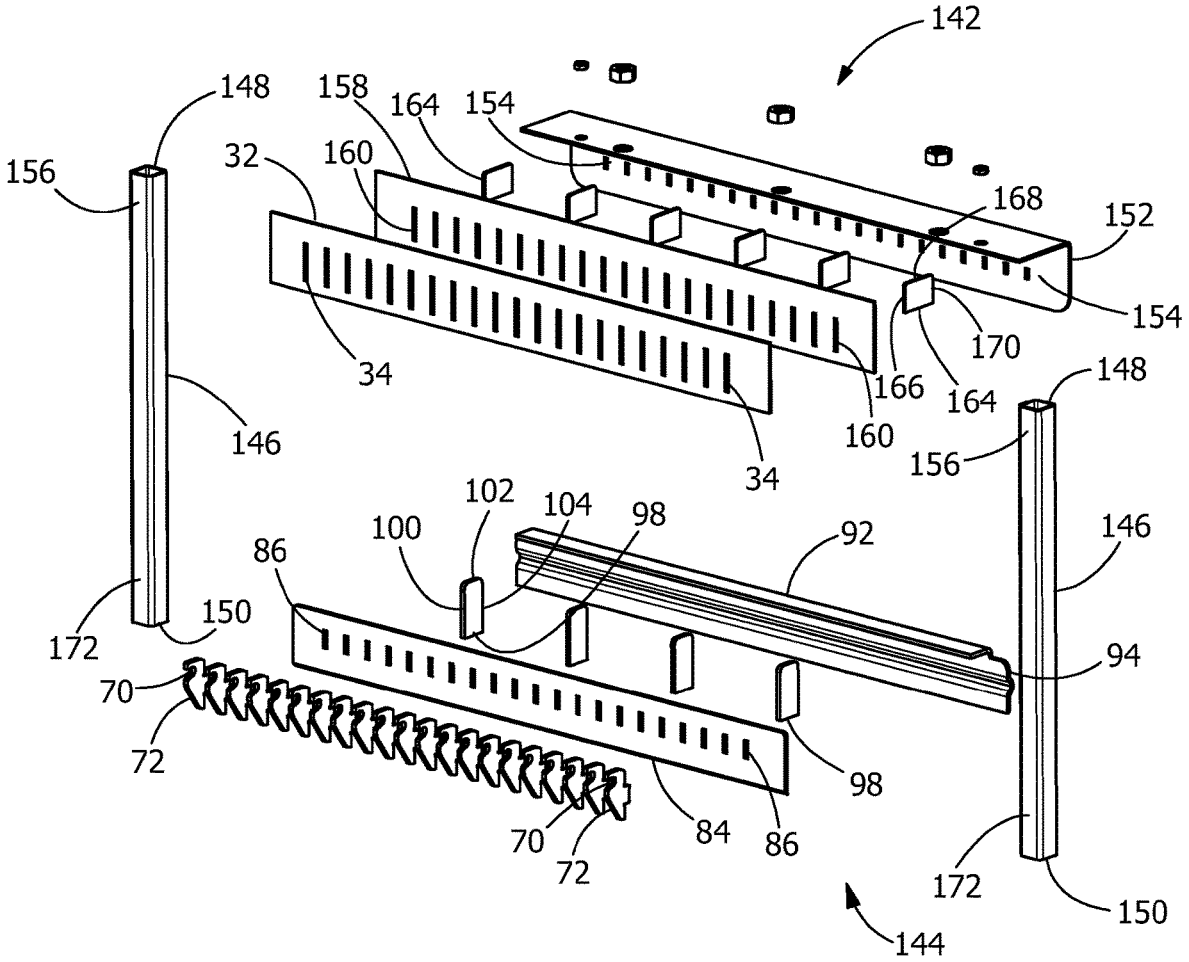
FIG. 21 is an exploded view of the partially exploded cartridge frame of FIG. 14.

As shown collectively in FIGS. 14-21, and more specifically, FIGS. 14 and 21, another exemplary open rectangular frame 140 is now discussed. Frame 140 has an upper frame portion 142 such as a weldment defining a C shape, and a lower frame portion 144 such as a weldment defining a C shape. As shown in FIGS. 14 and 21, upper frame portion 142 includes a pair of opposed tubes 146 such as rectangular tubes each having opposed ends 148, 150. An L-shaped member 152 having a plurality of slits 154 extends between and over each end 148 of the pair of tubes 146, L-shaped member 152 being mutually perpendicular to tubes 146. A plate 32 having a plurality of slits 34 is affixed to corresponding planar surfaces 156 near end 148 of tubes 146, and a plate 158 having a plurality of slits 160 is affixed to planar surfaces opposite surfaces 156 near end 148 of tubes 146. Collectively, as shown in FIG. 14, plate 158 and L-shaped member 152 form a continuous C-shaped structure 162 extending between tubes 146, with a portion of L-shaped structure 152 extending past C-shaped structure 162 and over ends 148 of tubes 146. A plurality of gussets 164 are inserted inside of C-shaped structure 162 with edges 166, 168, 170 of gussets 164 being affixed to inner corresponding surfaces of respective L-shaped member 152 and plate 158 to provide further structural stiffness and strength to upper frame portion 142. Each of aligned slits 34, 160 (FIG. 21), 154 of plates 32, 158 and L-shaped member 152 receive a blade fitting holder or holder 54.

FIG. 21 shows an exploded view of lower frame portion 144, which is similar to previously discussed upper frame portion 142 (FIG. 1) is now discussed (FIG. 14 shows the assembled lower frame portion 144). Lower frame portion 144 includes a pair of opposed tubes 146 such as rectangular tubes each having opposed ends 148, 150. A plate 84 having a plurality of slits 86 is affixed to corresponding planar surfaces 172 near end 150 of tubes 146, plate 84 being mutually perpendicular to parallel tubes 146. Slits 86 are adapted to each receive a protrusion 90 of a corresponding holder 72 that are then welded together or otherwise appropriately secured to one another. As further shown in FIG. 21, an L-shaped member 92 having a stiffening ridge 94 formed along its length extends between tubes 146 near ends 150. As shown in FIG. 14, plate 84 and L-shaped member 92 form a continuous C-shaped structure 96 extending between tubes 146 near ends 150 of tubes 146. A plurality of gussets 98 (FIG. 21) are inserted inside of C-shaped structure 96 with edges 100, 102, 104 (FIG. 21) of gussets 98 (FIG. 21) being affixed to inner corresponding surfaces of respective plate 84 and L-shaped member 92 to provide further structural stiffness and strength to C-shaped structure 96 of lower frame portion 144.

Holders 54, 72 operate in a manner similar as previously discussed to be secured to the blades 18, except the manner that some forces applied to holders 54 are for selectively controlling/maintaining tension for frame 140 is different as compared to frame 12, although both frames 12, 140 are adapted to selectively adjust and maintain the tension of blades 18, including maintaining the blades in a condition without tension.

Figure 19:
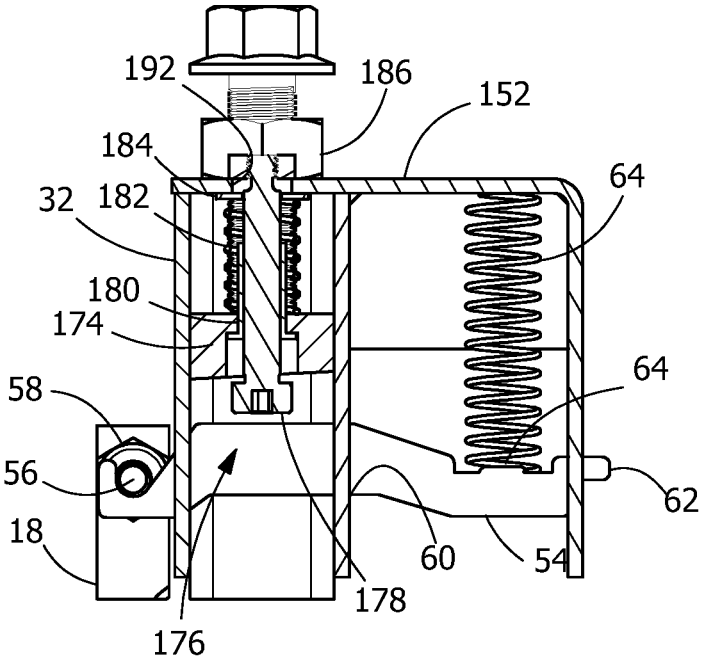
FIG. 19 is a view taken along line 19-19 of the assembled cartridge frame of FIG. 15.
Figure 20:
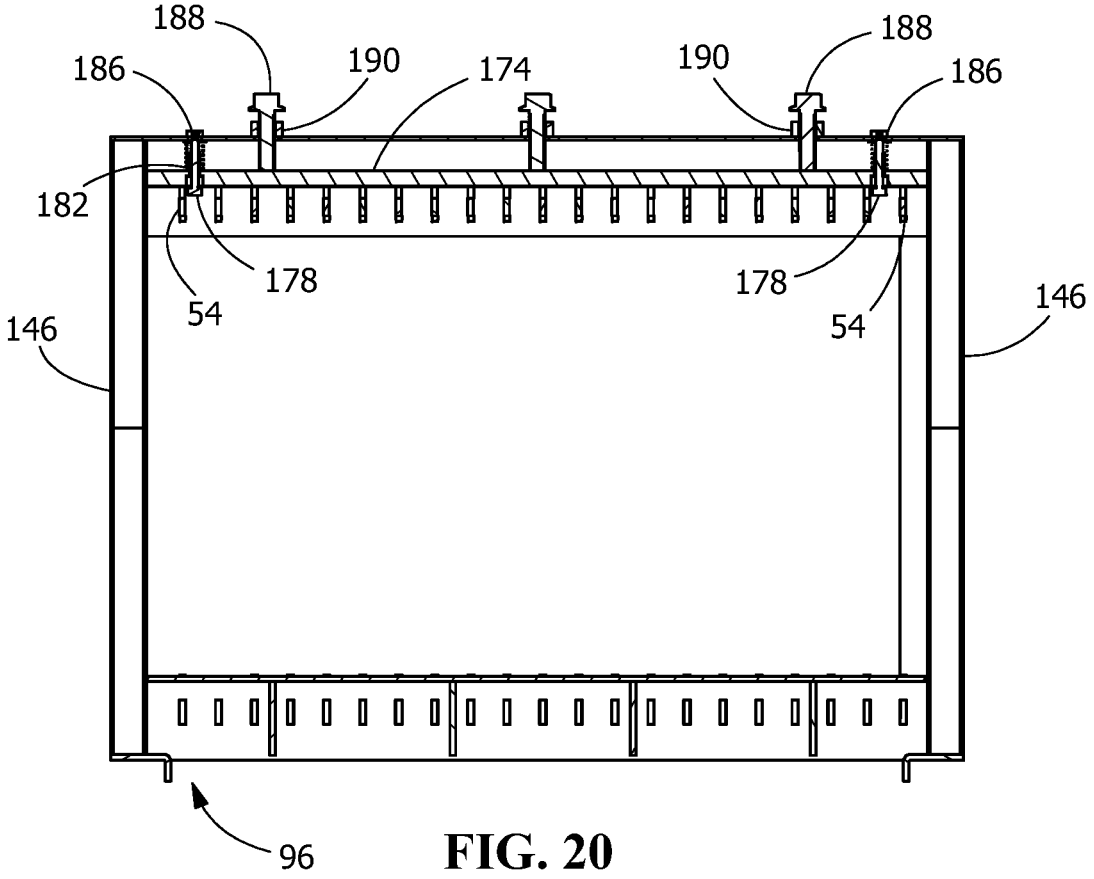
FIG. 20 is a view taken along line 20-20 of the assembled cartridge frame of FIG. 16.

For example, as shown in FIG. 19, a bar 174 extends between tubes 146 (FIG. 14) near ends 148 (FIG. 14) of tubes 146. Bar 174 includes a pair of counterbored apertures 176 positioned near the opposed ends of bar 174 into which counterbored apertures 176 are inserted a flanged bushing 180 followed by a fastener 178 such as a bolt such as a shoulder bolt. The body of flanged bushing 180 is inserted through a spring 182 for slidably securing and laterally supporting spring 182 positioned between L-shaped member 152 and bar 174. Fastener 178 is also inserted through a washer 184 positioned between L-shaped member 152 and the shoulder of fastener 178, and finally fastener 178 is inserted through aperture 192 formed in L-shaped member 152 and threadedly engages nut 186. In this arrangement, until bar 174 contacts the head of fastener 178 that limits the downward travel of bar 174, bar 174 applies a downward force to holder 54 between feature 56 and notch 60 of holder 54 as a result of the retention force applied by compressed spring between bar 174 and washer 184, which downward force reduces tension on blade 18. The downward force applied by bar 174 to the left of notch 60 (fulcrum) of holder 54 is in opposition to the downward force applied to the right of notch 60 (fulcrum) by compressed spring 66 positioned between protrusion 64 of holder 54 and L-shaped member 152 as previously discussed.

Figure 18:
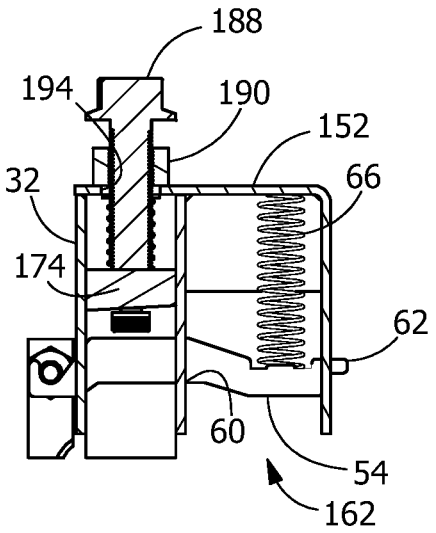
FIG. 18 is a view taken along line 18-18 of the assembled cartridge frame of FIG. 15.
Figure 23:
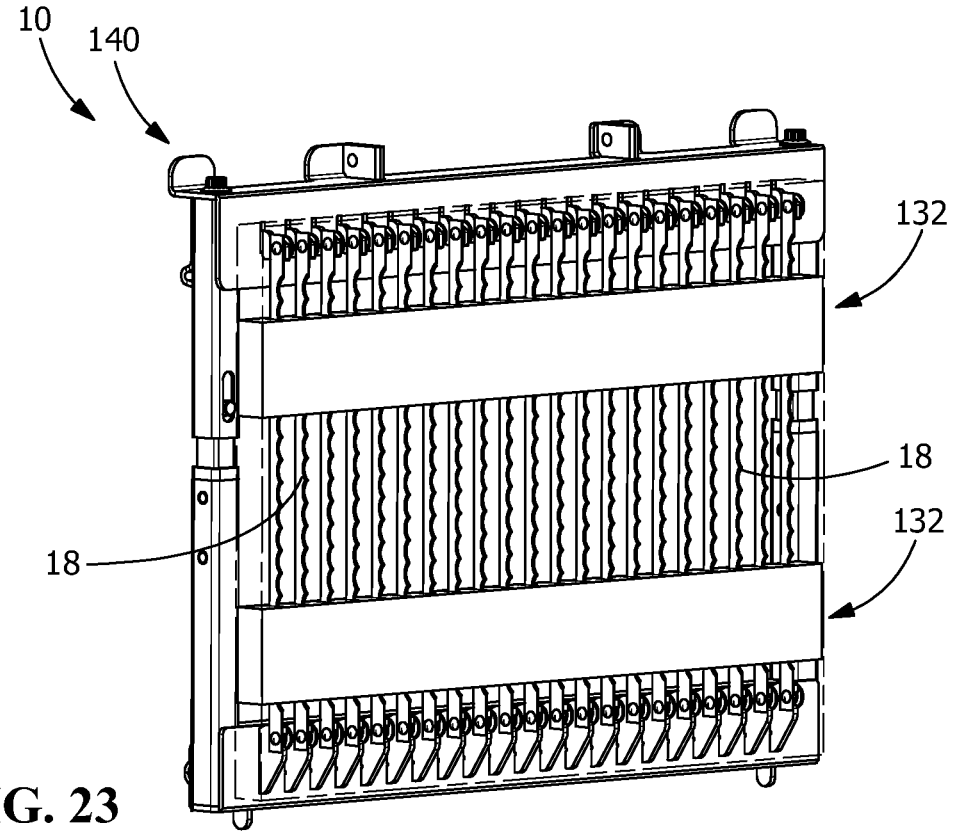
FIG. 23 is an upper perspective view of the blade carrier of FIG. 22 positioned to install a plurality of bread slicer blades in a cartridge frame.

In addition, as shown in FIG. 18, one or more, such as three drive fasteners 188 threadedly engage a corresponding nut 190 and associated aligned aperture 194 formed in L-shaped member 152. In response to sufficient rotational movement of drive fastener 188 in one direction, the end of drive fastener 188 is directed downward into contact with bar 174 between feature 56 and notch 60 of holder 54 (i.e., contact/downward force applied to the left of notch 60 (fulcrum), with further rotational movement similarly urging bar 178 into downward movement and reducing the tension of blade 18. In response to sufficient additional rotational movement of drive fastener 188 and associated mutual movement in a downward direction of bar 178 and counterclockwise rotational movement of holder 54 about notch 60 (fulcrum) all tension of blades are removed, permitting removal of blades 18 from frame 140 such as with blade carrier 132 (FIGS. 22, 23) as previously discussed. Conversely, once a new set of blades 18 has been installed, drive fastener(s) 188 may be urged into rotational movement in an opposite direction, thereby increasing tension in blades until the predetermined tension is achieved.

Figure 27A:
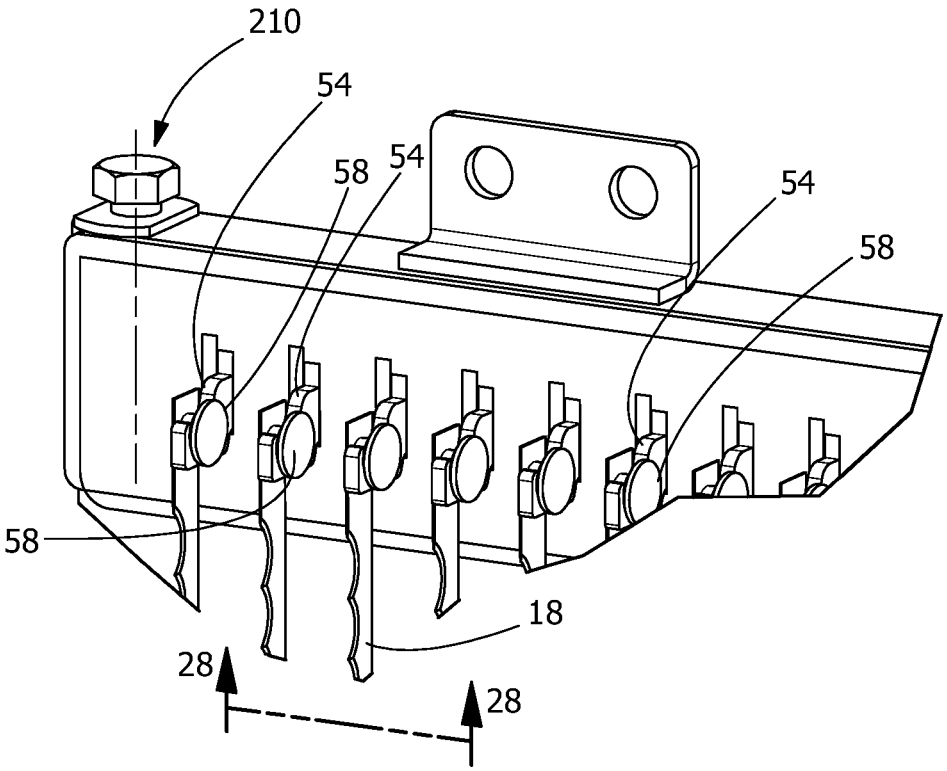
FIG. 27A is an enlarged partial view taken from region 27 of the plurality of bread slicer blades engaging corresponding holders of the cartridge frame of FIG. 24.
Figure 27B:
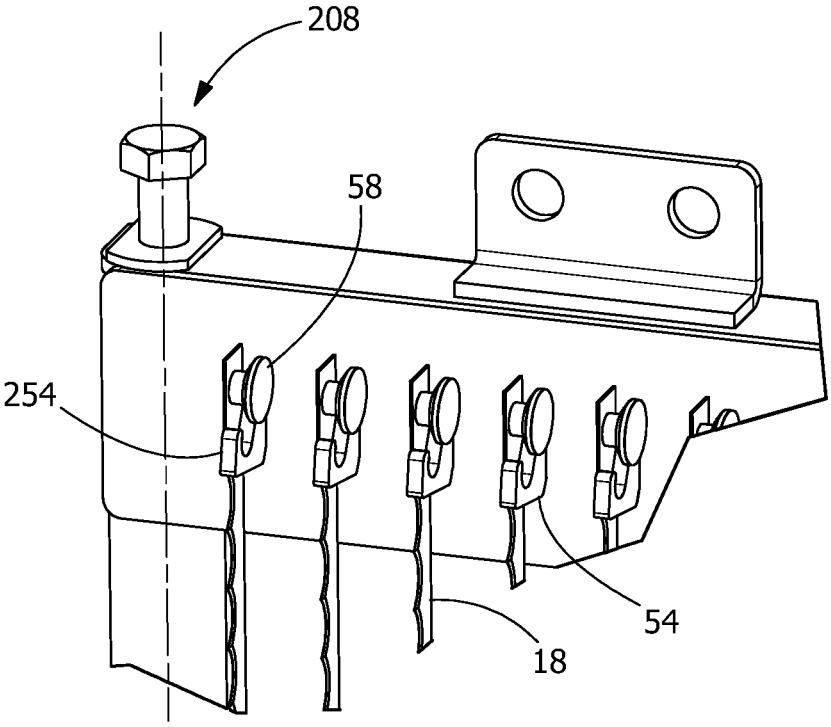
FIG. 27B is an enlarged partial view taken from region 27 of the plurality of bread slicer blades prior to engagement with corresponding holders of the cartridge frame of FIG. 24.
Figure 29:
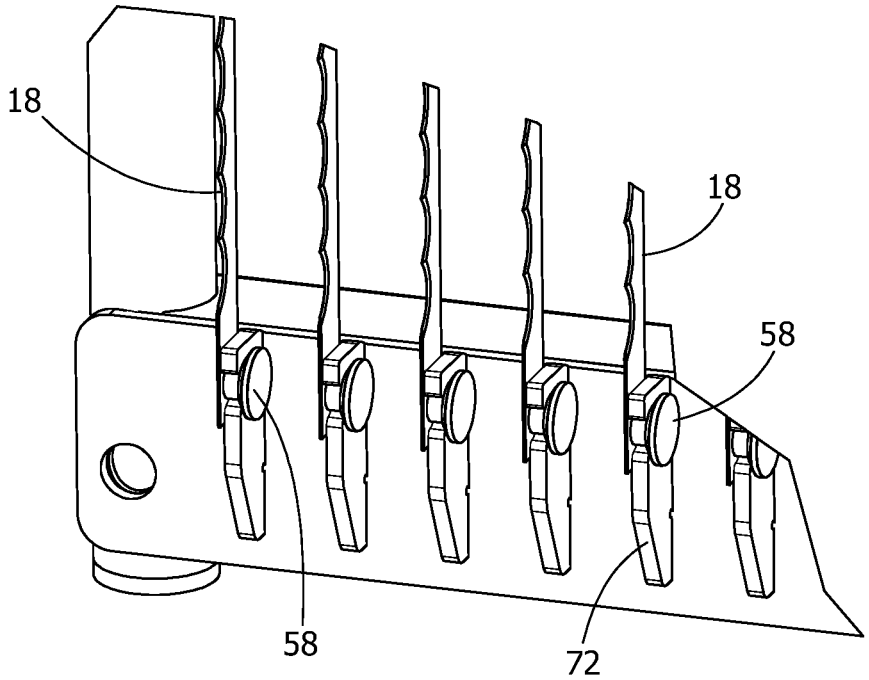
FIG. 29 is an enlarged, partial view taken from region 29 of a portion of the plurality of bread slicer blades engaging corresponding holders (as well as showing a different portion of the plurality of bread slicer blades prior to engaging corresponding holders) of the cartridge frame of FIG. 24.
Figure 28:
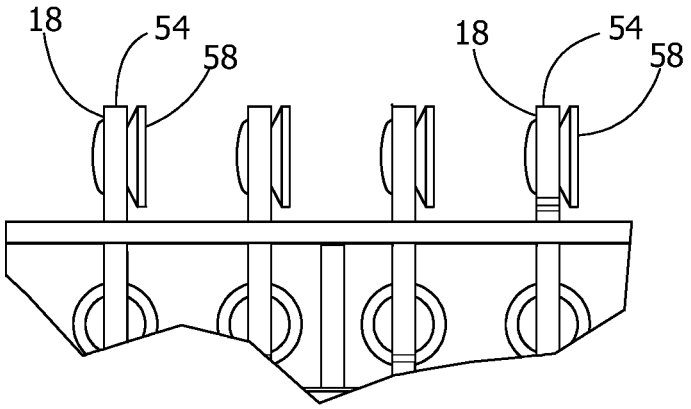
FIG. 28 is an enlarged view taken along line 28-28 of the cartridge frame of FIG. 27A.

FIGS. 24-26 are directed to an exemplary frame 200 that is similar to frame 12 (FIG. 1), except frame 200 does not utilize spring 120 (FIG. 1), as will now be discussed. That is, as shown in FIG. 26, tube 202 of frame 200 is similar to tube 22 (FIG. 1) of frame 12 (FIG. 1), except that tube 202 includes a threaded aperture 206 for receiving fastener 122. Similarly, insert 204 of frame 200 is similar to insert 20 (FIG. 1) of frame 12 (FIG. 1) except that insert 204 lacks threaded aperture 124 (FIG. 1). As a result, directing fastener 122 in rotational movement in one direction engages threaded aperture 206, further directing fastener 122 inside of tube 202 until the end of fastener 122 abuts or contacts end 126 of insert 204, causing insert 204 and tube 76 to move relative to tube 202, which movement being limited by the extent of travel of spring pin 116 within slot 118 as previously discussed. Stated another way, subject to travel limitations of spring pin 116 within slot 118, in response to increased threaded insertion of fastener 122 inside of tube 202 after the end of fastener 122 abuts or contacts end 126 of insert 204 (e.g., a substantially fully inserted position 210; FIG. 24, 27A), the distance between holders 56, 58 (FIG. 25)

increases, thereby placing corresponding blades 18 (FIG. 25) in tension. Conversely, subject to travel limitations of spring pin 116 within slot 118, in response to sufficiently reversing rotational movement of fastener 122 so as to direct fastener 122 by threaded engagement with tube 202 out of tube 202 until the end of fastener 122 (e.g., retracted fastener position 208; FIG. 27B) no longer abuts or contacts end 126 of insert 204, and the distance between holders 56, 58 (FIG. 25) decreases, thereby removing the tensile force from corresponding blades 18 (FIG. 25).

As shown collectively in FIGS. 27A, 28, 29, 30, feature 58 of blade 18 is now discussed. As appreciated by those having ordinary skill in the art, even with benefit of blade carriers 132 (FIG. 22), 212 (FIG. 31), it can be a challenging matter to simultaneously align/engage blade features 58 of a plurality of blades 18 with corresponding holders 54, 72 of the cartridge frame 12 (FIG. 1), 200 (FIG. 24) associated with installation of the plurality of blades 18. That is, even with the plurality of blades 18 secured in the blade carriers and arranged in mutual axial alignment, as a result of tolerances, if lateral positioning of any one (or more) of the blade holders relative to the positioning of the corresponding engagement features of the blades are not sufficiently aligned, installation of the blades cannot occur, as such installation occurs simultaneously. As a result, it would be extremely beneficial to effectively increase the lateral tolerance without overly increasing the spacing between the blades.

Figure 30:
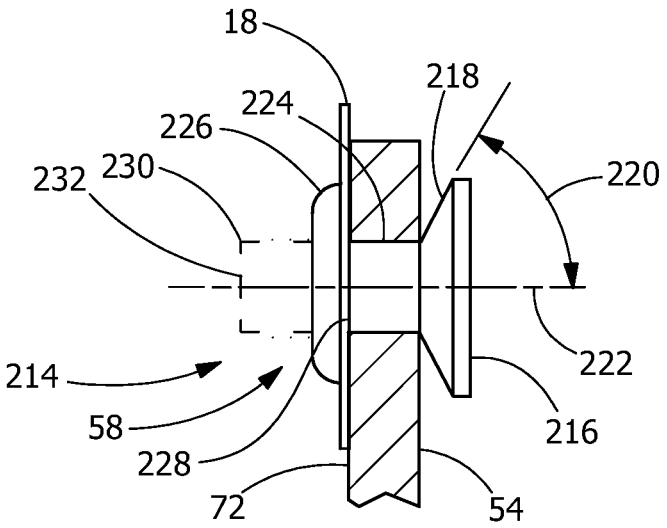
FIG. 30 is an enlarged view of an end of one bread slicer blade of FIG. 28 with the corresponding holder shown in phantom lines.

As shown in FIG. 30, feature 58 of blade 18 comprises a fastener 214 having a center axis 222 resembling a double headed rivet after assembly to a blade 18. Fastener 214 has a head 216 having a surface 218 generally defining an acute angle 220 subtended between center axis 222 and surface 218, which surface 218 defined by rotating acute angle 220 about center axis 222. The term "generally defining" in the context of generally defining an acute angle 220 is used, as surface 218 is not constrained to have a linear profile, e.g., surface 218 can define a curved profile or include at least a partially non-linear profile portion, so long as the surface is continuous, generally smooth and the profile generally resembles that of a countersink head such as commonly used with countersink fasteners. Fastener 214 extends in a direction parallel to center axis 222 from head 216 to a shank portion 224, terminating at a shoulder 228, with an additional shank portion 230 extending from shoulder 228 to an end 232. During assembly, shank portion 230 receives a corresponding aperture of an end of blade 18 with blade 18 resting in contact with shoulder 228. During assembly, end 232 (and conventionally, head 216) are subjected to compressive forces such as high impulse forces (commonly referred to as bucking as in rivet bucking) resulting in the material of shank portion 230 deforming into a head 226 thereby capturing blade 18 between head 226 and shoulder 228, leaving shank portion 230 generally intact that defines a gap between blade 18 and head 216 for receiving a corresponding blade holder 54, 72. However, as a result of surface 218 of head 216 generally defining an acute angle relative to center axis 222, the distance as measured in a direction parallel to center axis 222 between blade 18 and surface 218 increases as the perpendicular distance from center axis 222 increases. This beneficial increase in distance in the direction parallel to center axis 222 as the perpendicular distance from center axis 222 increases provides an increase in lateral tolerance, as an outer edge of a corresponding holder 54, 72 contacting surface 218 will tend to slide along surface 218 toward shank portion 230 for engagement with shank portion 230, simplifying installation or assembly/engagement of the plurality of blades 18 with their corresponding blade holders 54, 72.

Figure 31:
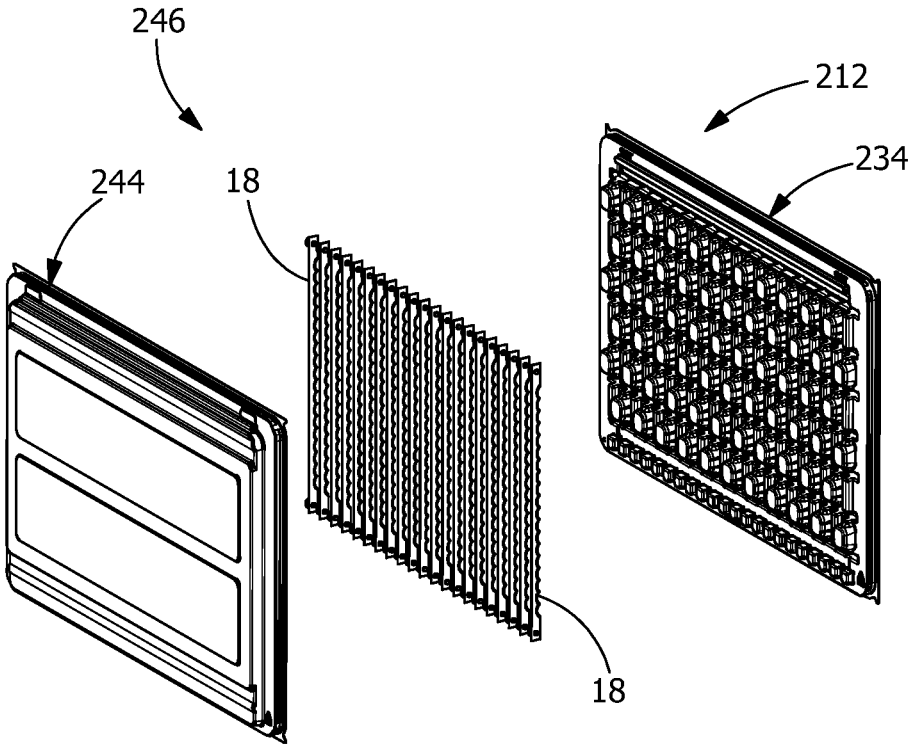
FIG. 31 is an exploded view of an exemplary blade carrier for carrying a plurality of bread slicer blades.
Figure 32:
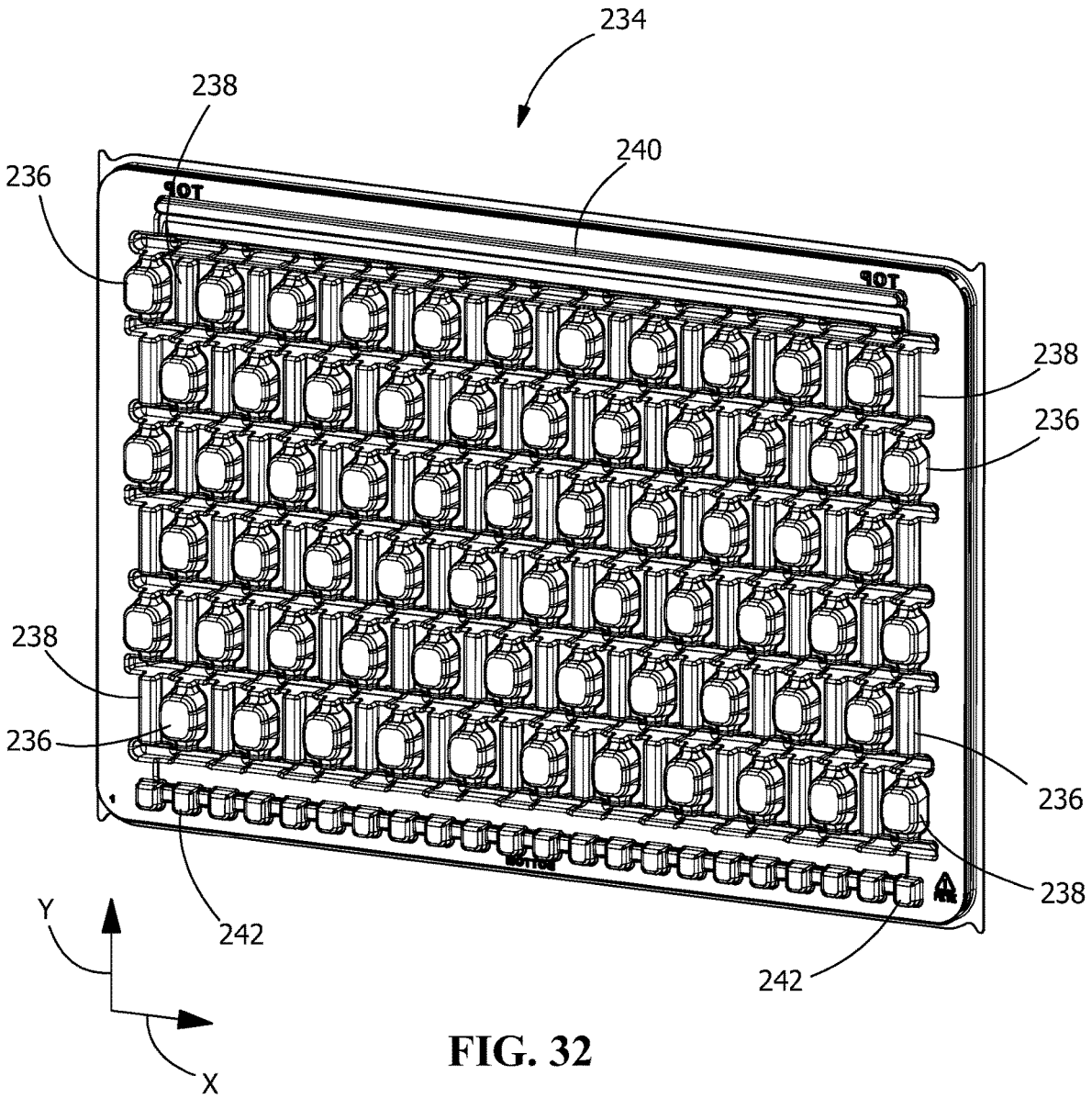
FIG. 32 is an enlarged upper perspective view of the blade carrier of FIG. 31.
Figure 33:
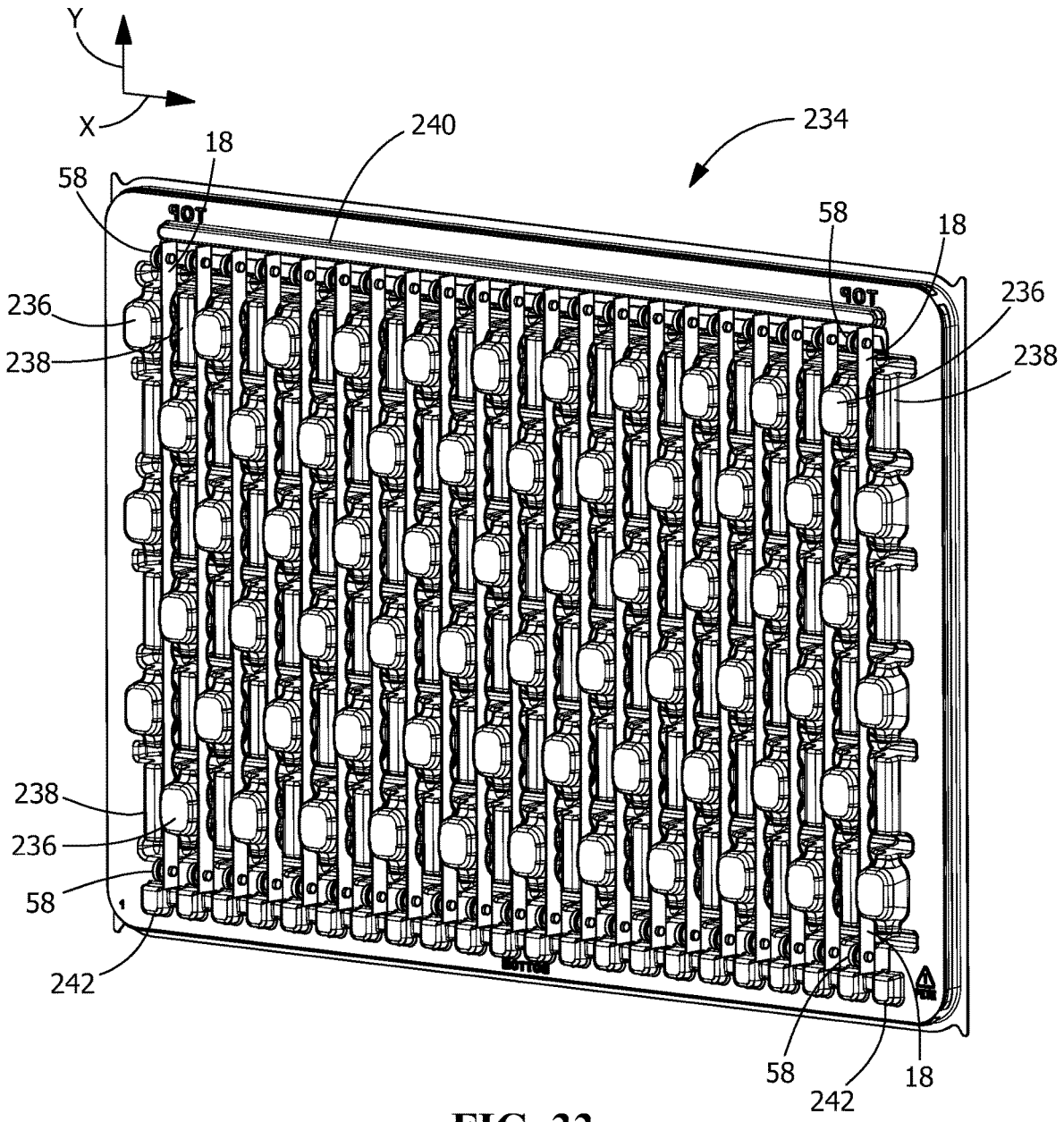
FIG. 33 is an enlarged upper perspective view of the blade carrier of FIG. 31 carrying a plurality of bread slicer blades.

FIGS. 31-33 show an exemplary blade carrier 212 including a container portion 234 having protrusions 236, 238, 240, 242 (FIGS. 32, 33) for securing a plurality of blades 18 thereby, and a corresponding container portion 244 configured to be engage container portion 234 for defining a protective enclosure 246 for transporting or storing the plurality of blades. As shown in FIG. 33, container portion 234 includes a plurality of protrusions 236, 238 alternatingly arranged in both the X direction and the Y direction, the plurality of protrusions 236, 238 are aligned in the first direction for receiving the plurality of blades 18 extending parallel to one another in the Y direction. The alternate arrangement and shape of the protrusions hold the blades in a particular orientation needed for loading into the cartridge while also providing structure to the overall package. As further shown, protrusion 240 extends along in the X direction for collectively aligning the plurality of blades 18 in the blade carrier. As still further shown, positioned at an opposite end of container portion 234 from protrusion 240 are a plurality of protrusions 242, each configured to contact a corresponding feature 58 of blade 18 such that features 58 of each blade 18 is secured in mutual alignment in the Y direction. The protrusions are positioned and shaped to permit container portion 234 to be brought toward a corresponding frame, further permitting features 58 positioned at either end of blades 18 to be brought into engagement with corresponding holders 54 (FIG. 1) followed by bringing features 58 at the opposed ends of blades 18 into engagement with corresponding holders 72 (FIG. 1), or vice versa.

Figure 36:
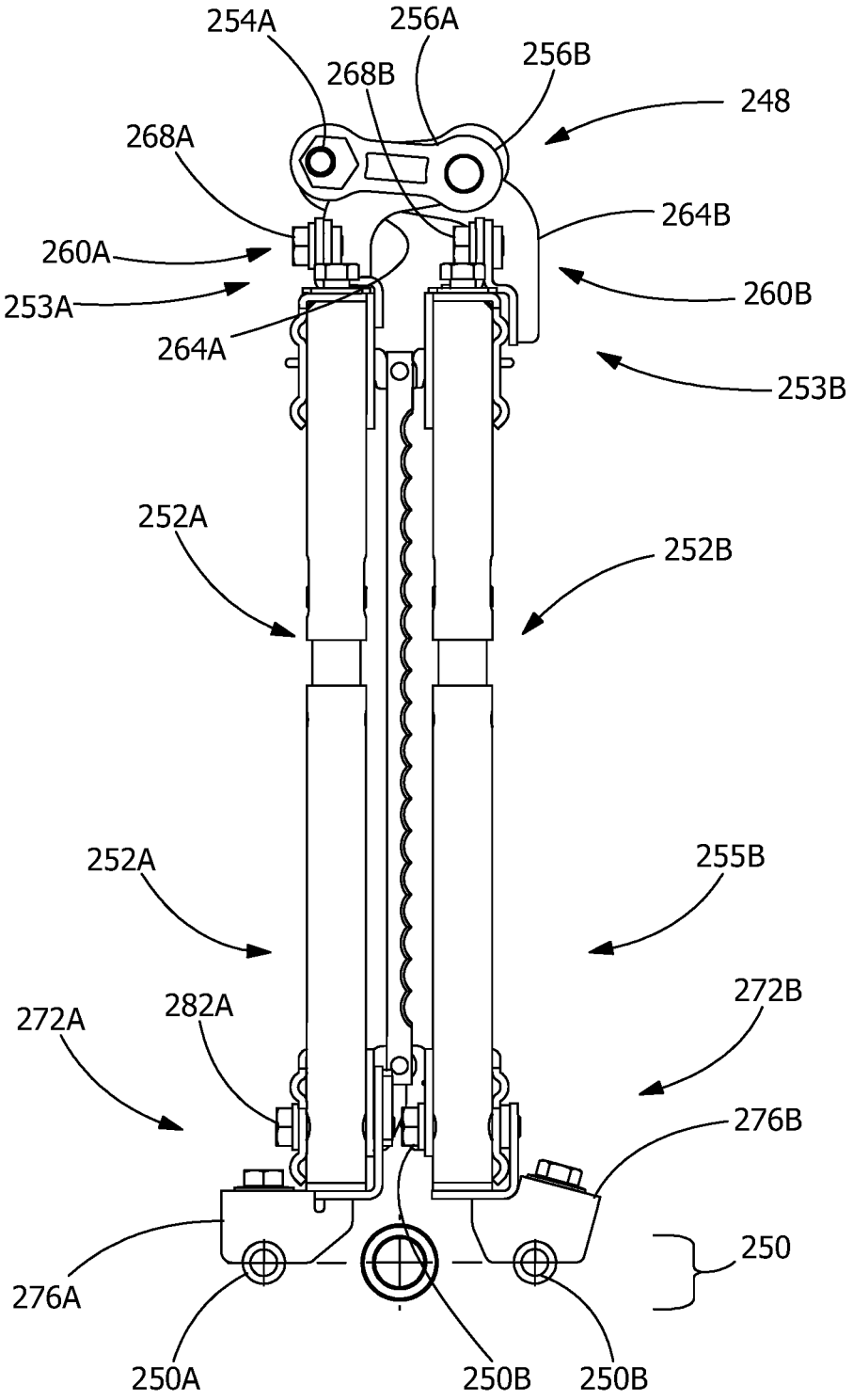
FIG. 36 is a side elevation view of the assembled frame cartridges of FIG. 35.

FIGS. 34-36 show a bread slicer 246 having upper engagement or mounting features 248 and lower engagement or mounting features 250 that selectively engage/disengage exemplary frames 252A, 252B, which frames and their associated components are identical, although the AB suffix designations are provided to provide clarification as to their relationships/engagements with corresponding engagement features. As shown, upper engagement features 248 include a pair of dog bone mount linkages 248A, 248B. Dog bone mount linkage 248A includes dog bone mount 254A rotatably coupled to dog bone 256A that is rotatably coupled to link 258A. Similarly, dog bone mount linkage 248B includes dog bone mount 254B rotatably coupled to dog bone 256B that is rotatably coupled to link 258B. Frame 252A includes a frame portion 253A comprising a frame subportion 260A including a bracket 262A to which is secured a curved member 264A having an aperture 266A for engaging link 258A. Frame subportion 260A is selectively secured to frame portion 253A by a pair of fasteners 268A and lock washers 270A. Frame 252B includes a frame portion 253B comprising a frame subportion 260B including a bracket 262B to which is secured a curved member 264B having an aperture 266B for engaging link 258B. Frame subportion 260B is selectively secured to frame portion 253B by a pair of fasteners 268B and lock washers 270B.

As further shown in FIG. 34, frame 252A further includes a frame portion 255A comprising a frame subportion 272A having a bracket 274A secured to a pair of fittings 276A by corresponding fasteners and lock washers 278A, 280A, which fittings 276A are configured to receive rocker rod 250A. Frame subportion 274A is selectively secured to frame portion 255A by a pair of fasteners 282A and lock washers 284A. Similarly, frame 252B further includes a frame portion 255B comprising a frame subportion 272B having a bracket 274B secured to a pair of fittings 276B by corresponding fasteners and lock washers 278B, 280B, which fittings 276B are configured to receive rocker rod 250B. Frame subportion 274B is selectively secured to frame 252B by a pair of fasteners 282B and lock washers 284B.

By virtue of this arrangement, when it is desired to remove frames 252A, 252B from the bread slicer, such as for reasons of replacing dulled blades or to change frames having a different blade spacing for providing bread slices of different thickness, the user only needs to remove fasteners 268A and associated lock washers 270A to permit separation of frame subportion 260A from frame portion 253A (curved member 264A of frame subportion 260A remains engaged with link 258A), and to also remove fasteners 282A and associated lock washers 284A to permit separation of frame subportion 272A from frame portion 255A (fitting 276A of frame subportion 272A can remain engaged with rocker rod 250A). Similarly, the user only needs to remove fasteners 268B and associated lock washers 270B to permit separation of frame subportion 260B from frame portion 253B (curved member 264B of frame subportion 260B remains engaged with link 258B), and to also remove fasteners 282B and associated lock washers 284B to permit separation of frame subportion 272B from frame portion 255B (fitting 276B of frame subportion 272B can remain engaged with rocker rod 250B).

Otherwise, disconnecting/reconnecting other/additional components than those previously discussed involves additional considerations, including alignment issues, which, for example, could occur if dog bone mount linkages 248A, 248B were to be disassembled, involving possible additional adjustments to ensure proper alignment/operation, which adjustments requiring special tooling and/or training not available to employees typically operating the bread slicer. By only requiring the disassembly/assembly of the above-referenced fasteners and lock washers, only the ability to disassemble, replace the blade frames, reassemble and retighten threaded fasteners in their respective threaded apertures is required, sufficiently simplifying such assembly/disassembly to be within the capabilities of many employees operating the bread slicer, which previously would have required a service visit from a technician, and as a result, the frames would rarely, if ever be changed out/replaced.

In one embodiment, device 196 may be configured for use with radio frequency identification (RFID), including a compatible reading device 198. An example of a reading device is a Falcon 550 Series RFID Mobile Computer manufactured by PSC Technologies, headquartered in Virginia Beach, Va. However device 196 is not limited to RFID, and may make use of other identification techniques, such as a microwave-based identification system. In another embodiment, optical bar codes or other techniques suitable for use with cartridges, and the associated reading devices, if desired. In one embodiment, reading device 198 is a controller for a bread cutting machine.

In one embodiment, device 196 and reading device 198 of the present disclosure is intended to enhance quality control associated with blade life of the blades in the frame by the reading device 198 reading the information retained or stored by the device. At least a portion of the information stored by the device 196 is associated with the identification of the frame in which the device is installed. In one embodiment, device 196 records a number of reciprocation cycles that occurred with the frame including the device over a predetermined period of time, summing the total number of reciprocation cycles to be monitored/report to a user of the bread cutting machine. In one embodiment, device 196 begins with a predetermined number of reciprocating cycles associated with a new set of blades, and the predetermined number is reduced by the number of reciprocating cycles during operation of the bread cutting machine, until the number approaches zero or is a negative number, indicating the blade life has been exceeded, and notifying the operator of this circumstance. The particular quality control techniques available to a user and integration of those techniques are virtually limitless, well known, and are not further discussed herein, and include the capability of reading the device 196.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A cartridge adapted to secure reciprocating bread slicer blades, comprising:

a rectangular frame having a planar surface, the frame having a plurality of pairs of opposed holders, each pair of the opposed holders adapted to releasably secure opposed ends of a corresponding bread slicer blade; and a plurality of aligned bread slicer blades;

wherein the frame is adapted to secure the plurality of aligned bread slicer blades defining a plane offset from the frame planar surface;

wherein the frame is adapted to selectively maintain each of the plurality of aligned bread slicer blades in tension;

wherein a length of the frame extending in a direction parallel to the plurality of blades is selectively variable, and wherein the frame includes an upper frame portion having a pair of opposed tubes and a lower frame portion having a pair of opposed tubes, wherein an insert is provided between the respective tubes of the upper and lower frame portions to join the upper frame portion and the lower frame portion together.

2. The cartridge of claim 1, wherein each end of the bread slicer blades includes a feature for receiving a corresponding holder, the feature defining a gap between the end of the bread slicer blade and a head portion, the head portion having a surface generally defined by an acute angle rotated about a center axis.

3. The cartridge of claim 1, wherein in response to the frame length in the direction parallel to the plurality of blades being a predetermined length, tension is removed from the plurality of aligned bread slicer blades, permitting removal of the plurality of aligned bread slicer blades from the cartridge.

4. The cartridge of claim 1, wherein one holder of each pair of holders comprises a lever.

5. The cartridge of claim 1, wherein the frame comprises a device for recording a number of reciprocation cycles of the plurality of bread slicer blades.

6. The cartridge of claim 1, wherein the insert includes an upper portion and a lower portion separated by a peripheral ridge.

7. The cartridge of claim 6, wherein the upper portion of the insert is inserted in one of the pair of opposed tubes of the upper frame portion and the lower portion of the insert is inserted in one of the pair of opposed tubes of the lower frame portion.

8. A system adapted to secure reciprocating bread slicer blades comprising:

a rectangular frame having a planar surface, the frame having a plurality of pairs of opposed holders, each pair of the opposed holders adapted to releasably secure opposed ends of a corresponding bread slicer blade;

a plurality of aligned bread slicer blades;

wherein the frame is adapted to secure a plurality of aligned bread slicer blades defining a plane offset from the frame planar surface;

wherein a length of the frame extending in a direction parallel to the plurality of blades is selectively variable;

wherein the frame is adapted to selectively maintain each of the plurality of aligned bread slicer blades in tension during use;

wherein the frame is adapted to selectively remove tension from each of the plurality of aligned bread slicer blades during non-use;

wherein the frame includes an upper frame portion having a pair of opposed tubes and a lower frame portion having a pair of opposed tubes, wherein an insert is provided between the respective tubes of the upper and lower frame portions to join the upper frame portion and the lower frame portion together; and a blade carrier capable of carrying the plurality of bread slicer blades, the blade carrier permitting installation or removal of the plurality of bread slider blades from/into the frame.

9. The system of claim 8, wherein each end of the bread slicer blades includes a feature for receiving a corresponding holder, the feature defining a gap between the end of the bread slicer blade and a head portion, the head portion having a surface generally defined by an acute angle rotated about a center axis.

10. The system of claim 8, wherein in response to the frame length in the direction parallel to the plurality of blades being a predetermined length, tension is removed from the plurality of aligned bread slicer blades, permitting removal of the plurality of aligned bread slicer blades from the cartridge.

11. The system of claim 8, wherein one holder of each pair of holders comprises a lever.

12. The system of claim 8, wherein the frame comprises a device for recording a number of reciprocation cycles of the plurality of bread slicer blades.

13. The system of claim 8, wherein the blade carrier comprises a plurality of first and second protrusions alternatingly arranged in a first direction and a second direction, the plurality of first and second protrusions aligned in the first direction for receiving the plurality of bread slicer blades.

14. The system of claim 13, wherein the blade carrier comprises a third protrusion extending in the second direction for collectively aligning the plurality of bread slicer blades in the blade carrier.

15. A bread slicer, comprising:

a rectangular frame having a planar surface, the frame having a plurality of pairs of opposed holders, each pair of the opposed holders adapted to releasably secure opposed ends of a corresponding bread slicer blade; and a plurality of aligned bread slicer blades;

wherein the frame is adapted to secure a plurality of aligned bread slicer blades defining a plane offset from the frame planar surface;

wherein a length of the frame extending in a direction parallel to the plurality of blades is selectively variable;

wherein the frame is adapted to selectively maintain each of the plurality of aligned bread slicer blades in tension;

wherein the frame includes an upper frame portion having a pair of opposed tubes and a lower frame portion having a pair of opposed tubes, wherein an insert is provided between the respective tubes of the upper and lower frame portions to join the upper frame portion and the lower frame portion together;

wherein the frame comprising a first frame portion and a second frame portion for each engaging a corresponding mounting feature of the bread slicer;

wherein the first frame portion comprising a first frame subportion selectively secured by at least one fastener thereto, and the second frame portion comprising a second frame subportion selectively secured by at least one fastener thereto, the first and second frame subportions are moveable with respect to the frame;

wherein upon selectively adjusting an amount of engagement of the at least one fastener of the first frame subportion, the first frame portion is movable in the direction parallel to the plurality of blades.

16. The bread slicer of claim 15, wherein each end of the bread slicer blades includes a feature for receiving a corresponding holder, the feature defining a gap between the end of the bread slicer blade and a head portion, the head portion having a surface generally defined by an acute angle rotated about a center axis.

17. The bread slicer of claim 15, wherein in response to the frame length in the direction parallel to the plurality of blades being a predetermined length, tension is removed from the plurality of aligned bread slicer blades, permitting removal of the plurality of aligned bread slicer blades from the cartridge.

18. The bread slicer of claim 15, wherein one holder of each pair of holders comprises a lever.

19. The bread slicer of claim 15, wherein the frame comprises a device for recording a number of reciprocation cycles of the plurality of bread slicer blades.

* * * * *